US011017632B2

(12) United States Patent
Oberberger et al.

(10) Patent No.: US 11,017,632 B2
(45) Date of Patent: *May 25, 2021

(54) REGULATED CASINO GAMES, GAMING MACHINES AND COMPUTER-IMPLEMENTED METHODS HAVING PAYOUT SCHEDULES AND ASSOCIATED RETURNS TO PLAYER (RTPS) SELECTED BASED UPON TIME TO SUCCESSFUL INTERACTION

(71) Applicant: SYNERGY BLUE, LLC, Las Vegas, CA (US)

(72) Inventors: Michael M Oberberger, Spring Hill, TN (US); Michael M Low, Henderson, NV (US)

(73) Assignee: SYNERGY BLUE LLC, Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/789,004

(22) Filed: Feb. 12, 2020

(65) Prior Publication Data

US 2020/0265673 A1 Aug. 20, 2020

Related U.S. Application Data

(63) Continuation of application No. 16/154,096, filed on Oct. 8, 2018, now Pat. No. 10,643,428, which is a (Continued)

(51) Int. Cl.
*G07F 17/32* (2006.01)

(52) U.S. Cl.
CPC ..... *G07F 17/3244* (2013.01); *G07F 17/3223* (2013.01); *G07F 17/3269* (2013.01)

(58) Field of Classification Search
USPC ..... 463/20, 23, 25
See application file for complete search history.

(56) References Cited

U.S. PATENT DOCUMENTS

2017/0084124 A1* 3/2017 Brunet de Courssou ..... G07F 17/3267
2018/0005483 A1* 1/2018 Washington ..... G07F 17/3213
(Continued)

*Primary Examiner* — Pierre E Elisca
(74) *Attorney, Agent, or Firm* — Young Law Firm, P.C.

(57) ABSTRACT

A computer-implemented method of operating a regulated gaming machine may comprise accepting funds, in the regulated gaming machine, from a player and correspondingly establishing player game credits. A game may be provided that comprises a plurality of in-game assets, each of which being configured to generate a wagering opportunity when interacted with by the player. One or more player interactions may be received, with at least one the plurality of in-game assets. For each generated wagering opportunity, it may be determined whether the received player interaction(s) resulted in a successful or an unsuccessful interaction with the in-game asset. For each successful interaction, a time elapsed until successful interaction and a wagering event may be generated. For one or more of the generated wagering events, the determined time elapsed until successful interaction may be used to select one of a plurality of payout schedules, each of which being associated with a different return to player (RTP) percentage. An award of player game credits may be generated according to the selected payout schedule and the RTP associated with the selected payout schedule, such that shorter times elapsed until successful interaction cause a selection of payout schedules that are more advantageous to the player than comparatively longer times elapsed until successful interaction.

20 Claims, 19 Drawing Sheets

Related U.S. Application Data continuation-in-part of application No. 15/920,272, filed on Mar. 13, 2018.

(56) References Cited

U.S. PATENT DOCUMENTS

| | | | | |
|---|---|---|---|---|
| 2018/0025583 | A1* | 1/2018 | Haag | G07F 17/3225 463/25 |
| 2018/0308314 | A1* | 10/2018 | Sanford | G07F 17/3244 |
| 2018/0357860 | A1* | 12/2018 | Pettie | G07F 17/3211 |
| 2019/0012880 | A1* | 1/2019 | Palermo | G07F 17/3246 |

* cited by examiner

REGULATED CASINO GAMES, GAMING MACHINES AND COMPUTER-IMPLEMENTED METHODS HAVING PAYOUT SCHEDULES AND ASSOCIATED RETURNS TO PLAYER (RTPS) SELECTED BASED UPON TIME TO SUCCESSFUL INTERACTION

BACKGROUND

The introduction of skill-based casino games has transformed the industry and opened up a great variety of arcade-type games designed to appeal to a younger player demographic. However, players of great skill and/or players that have mastered game play often find that they do not enjoy an advantage over comparatively less skilled players, which leads to some measure of frustration. Conventional regulated casino games generally have a predetermined RTP for all interactions with in-game assets, irrespective of the skill or speed of the player.

BRIEF DESCRIPTION OF THE DRAWINGS

FIG. 20 also shows exemplary tangible, non-transitory computer-readable media having data stored thereon representing sequences of instructions which, when executed by the regulated gaming computing device, cause the regulated gaming computing device to determine rewards due to a player playing a wager-based game according to embodiments.

DETAILED DESCRIPTION

Figure 1:
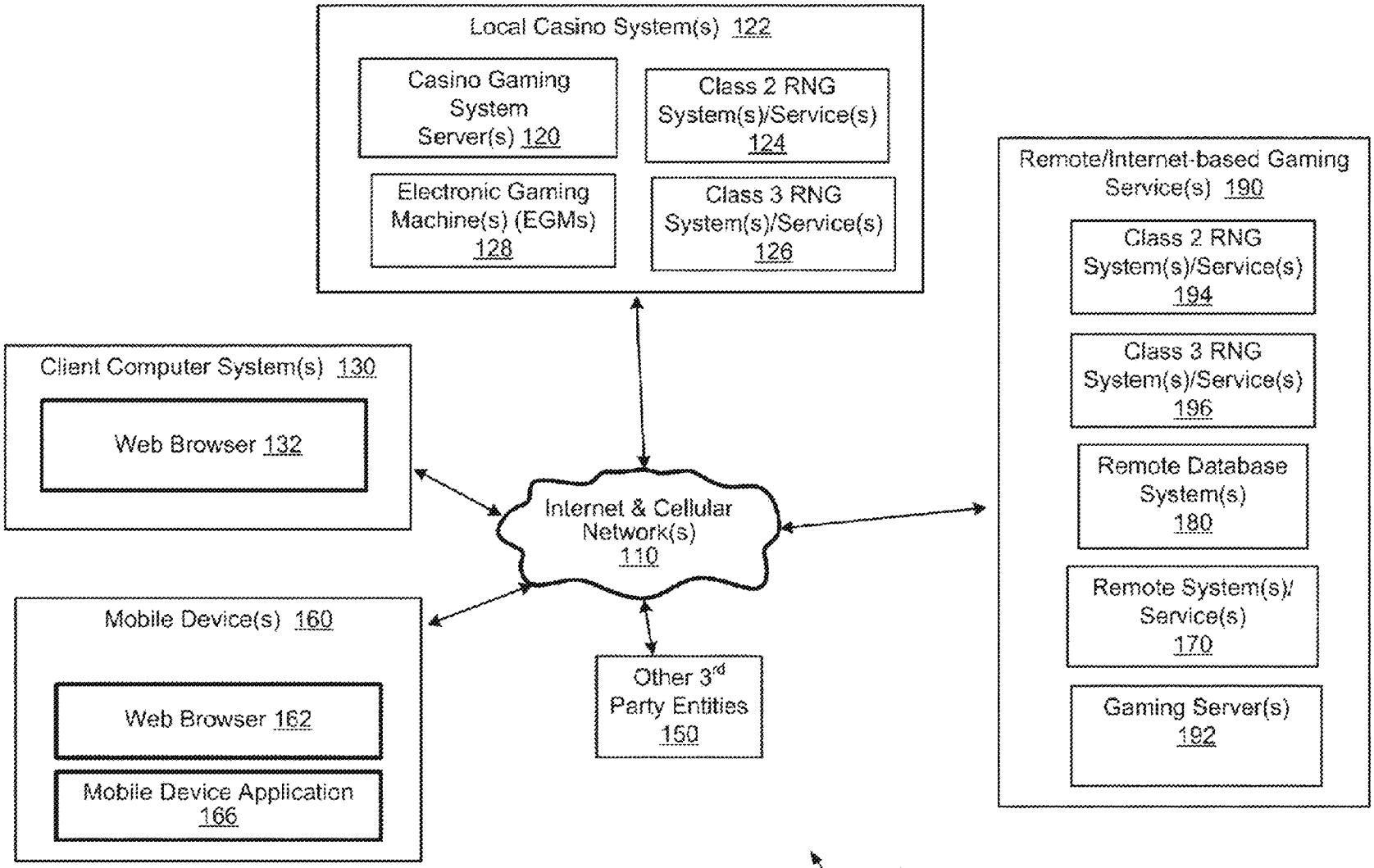
FIG. 1 illustrates a block diagram of a gaming network suitable for implementing embodiments.

Embodiments shown and described herein are directed to methods, devices systems, and computer program products providing regulated casino games having payout schedules and associated RTPs selected based at least in part on time to successful interaction with in-game assets.

Veteran gamblers (e.g., older gambler demographic age 50+) have been accustomed to a standard set of video gaming symbols (e.g., A, J, K, Q from playing cards) which, for example, may be accompanied with a multitude of additional themed symbols (e.g., fruits, animals, fantasy creatures, media personas, etc.) presented on a series of wheels or drums. Newer technology has made possible the use of digital display screens that present the reels and symbols in a digital format. Such existing slot machine technology, however, is dated and may be unappealing to younger players. Indeed, younger gamblers (e.g., also referred to as "gamers"), on the other hand, are accustomed to home gaming consoles (Nintendo, XBOX, PlayStation and the like) that provide them with exquisitely-rendered immersive 2D & 3D game environments with which they can interact. These gamers, who are used to fast paced, energetic, and visually stunning games, feel that the display method of the traditional slot machines are unappealing, which leads to decreased revenue for casino operators.

It is desirable, therefore, to offer hybrid arcade/wager-based games or gambling arcade games that provide hybrid arcade-style, wager-based gaming techniques, which find a ready demographic in younger gamers. However, one significant obstacle regarding such hybrid arcade-style, wager-based gaming techniques is that they often rely on complex back end solutions that require lengthy and costly processes of regulatory review and approvals in many different gaming jurisdictions.

One possible workaround to this significant obstacle is to configure/design a hybrid arcade-style, wager-based game such that it is compliant with currently approved wager-based gaming regulatory standards such as, for example, the well-known GLI standards, which have already been approved in various gaming jurisdictions. One example of a GLI standard is the GLI-11 standard version 3.0, Published Sep. 21, 2016 by Gaming Laboratories International, LLC, which is incorporated herein by reference.

For example, in one embodiment, a hybrid arcade-style, wager-based game may be configured to provide an arcade-style gaming interface which enables a player to participate in an arcade-style game at the wager-based gaming machine. One or more events and/or activities performed by the player (e.g., during play of the arcade-style game) may automatically trigger a random number generator (RNG)-based wager that is compliant with applicable gaming standards, rules and regulations. Because such wager-based activities comply with currently existing GLI standard(s) (and/or other national, regional, local gaming rules and regulations), such hybrid arcade-style, wager-based games may not require additional regulatory approval for deployment in casino venues.

In one embodiment, a hybrid arcade-style, wager-based game may be created by combining a new and different visual game representation with a new and different method of player interaction. The hybrid arcade-style, wager-based game may be configured to provide a perceptually stimulating experience using a wide variety of human interface devices (HID), based on the theme/style of the gambling game at hand. For example, some games may utilize a gun controller for first person shooter games, or steering wheels, accelerator and brake pedals for driving games. These and other types of games and interactions may be adapted for hybrid arcade/wager-based gaming.

For example, the format of the hybrid arcade-style, wager-based game may also focus on other types of video and/or arcade-style games such as, for example, non-linear (e.g., open world) type video and/or arcade-style games such as, for example, Grand Theft Auto, linear type video and/or arcade-style games such as, for example, Half-Life, massively multiplayer online "MMO" type video and/or arcade-style games such as, for example, World of Warcraft, role-playing game "RPG" type video and/or arcade-style games such as, for example, Final Fantasy, and/or others, Such games may feature a player character that may be moved through the game world via player input, (e.g., HID), which allows for an increased sense of excitement through gameplay by providing a multitude of player-choice possibilities through a wide-array of path directions.

In some embodiments, the format of the hybrid arcade-style, wager-based game may facilitate a gameplay environment in which multiplayer functionality takes place. The multiplayer gameplay may have multiple "enrollment" aspects in which one, for example, particular player could be on location at a casino playing a hybrid arcade/wager-based game, while another (e.g., different) player could be at a different location, concurrently participating in the same hybrid arcade/wager-based game, but without participating in any wagering aspect/portions of hybrid arcade/wager-based game. A non-wagering game such as this is commonly known as a "free to play" game, which the player is allowed to download and install on their own devices. The player may then progress through the game (e.g., which is very similar to its the wager based counter-part) without taking part in wager-based events. Gaming situations such as these may promote a "clicks to bricks" outcome where a casino property promotes their games to home users and invites them to develop familiarity and expertise on non-wagering versions of the games. Later, those same home players may be invited to visit the casinos to play the hybrid arcade/wager version of the games.

In some embodiments, different players concurrently participating in the same hybrid arcade/wager-based game may each separately configure his/her respective wagering parameters/amounts, which may be different from the wagering parameters/amounts configured by other game player-participants.

FIG. 1 illustrates a block diagram of an embodiment of a hybrid arcade/wager-based gaming system 100 which may be implemented via a computer network. At least a portion of the various functions, actions, operations, and activities performed by one or more component(s) of the hybrid arcade/wager-based gaming system may be initiated in response to detection of one or more conditions, events, and/or other criteria satisfying one or more different types of minimum threshold criteria. According to embodiments, at least a portion of the various types of functions, operations, actions, and/or other features provided by the hybrid arcade/wager-based gaming system may be implemented at one or more client systems(s), at one or more system server(s), and/or combinations thereof. According to different embodiments, the present hybrid arcade/wager-based gaming system 100 may be implemented in hardware and/or combinations of hardware and software.

According to one embodiment, a hybrid arcade/wager-based gaming system 100 may include local casino system(s) 122, client computer systems 130, mobile devices 160 and remote/Internet-based gaming services 190 and other 3$^{rd}$ party entities 150, coupled to a computer/communication network 110. The local casino system(s) 122 may include local casino gaming system server(s) 120. The local casino system(s) 122 may also include and class 2 RNG system(s)/service(s) 124. The Class 2 RNG system(s)/service(s) 124 may be configured to dynamically generate and/or provide Class 2 gaming type RNG outcomes to be used by hybrid arcade/wager-based Gaming devices as "predetermined" RNG outcome(s). Class 3 RNG system(s)/service(s) 126 may also be provided to dynamically generate and provide Class 3 gaming "predetermined" RNG outcome(s). Local casino system(s) 122 may also include electronic gaming machine(s) (EGMs) 128 that may be configured as described herein below.

Client computer system(s) 130 may also be operable to couple to the network 110 and implement various types of functions, operations, actions, and/or other features such as those described or referenced herein via, for example, a web browser 132. Similarly, mobile computing devices 160 (e.g., mobile phones, tablets and the like) may be configured to access the network 110 and to use a mobile web browser 162 and/or one or more mobile applications (apps) 166 to implement some or all the functionality described herein. Third party entities 150 may also be configured to carry out some or all of the functionality described herein via the network 110.

Remote/Internet-based gaming service(s) 190 may also be coupled to network 110 and may comprise class 2 RNG system(s)/service(s) 194 as described relative to reference numeral 124, class 3 RNG system(s)/service(s) 196 as described relative to reference numeral 126, and remote database system(s) 180. Remote system(s)/service(s) 170 may be provided, which may include, for example, content provider servers/services, media streaming servers/services, database storage/access/query servers/services, financial transaction servers/services, payment gateway servers/services, electronic commerce servers/services, event management/scheduling servers/services and/or other services as needed. Remote/Internet-based gaming service(s) 190 may also include gaming servers 192.

According to embodiments, multiple instances or threads of hybrid arcade/wager-based gaming may be concurrently implemented and/or initiated via the use of one or more processors and/or other combinations of hardware and/or hardware and software. Embodiments may access and/or utilize information from one or more associated databases via communication with one or more local and/or remote memory devices.

According to different embodiments, various different types of encryption/decryption techniques may be used to facilitate secure communications over the network 110 and/or via other communication channels. For example, such encryption may utilize random number generators, SHA-1 (e.g., Secured Hashing Algorithm), MD2, MD5, DES (e.g., Digital Encryption Standard), 3DES (e.g., Triple DES), RC4 (e.g., Rivest Cipher), ARC4 (e.g., related to RC4), TKIP (e.g., Temporal Key Integrity Protocol, uses RC4), AES (e.g., Advanced Encryption Standard), RSA, DSA, DH, NTRU, and ECC (e.g., elliptic curve cryptography), PKA (e.g., Private Key Authentication), Device-Unique Secret Key and other cryptographic key data, SSL and/or others. Other security features may include use of well-known hardware-based and/or software-based security components, and/or any other known or yet to be devised security and/or hardware and encryption/decryption processes implemented in hardware and/or software.

Embodiments of hybrid arcade/wager-based gaming described herein may be implemented in hardware and/or a combination of both hardware and software. Possible implementations include in an operating system kernel, in a separate user process, in a library package bound into network applications, on a specially constructed machine, or on a network interface card. In a specific embodiment, various aspects described herein may be implemented in software such as an operating system or in an application running on an operating system.

Alternatively, hardware and/or software embodiments of present hybrid arcade/wager-based gaming techniques described herein may be implemented on a general-purpose programmable computer selectively activated or reconfigured by a computer program stored in memory. Such programmable machine may include, for example, mobile or handheld computing systems, PDA, smart phones, notebook computers, tablets, netbooks, desktop computing systems, system servers, cloud computing systems, network devices, etc.

Figure 2:
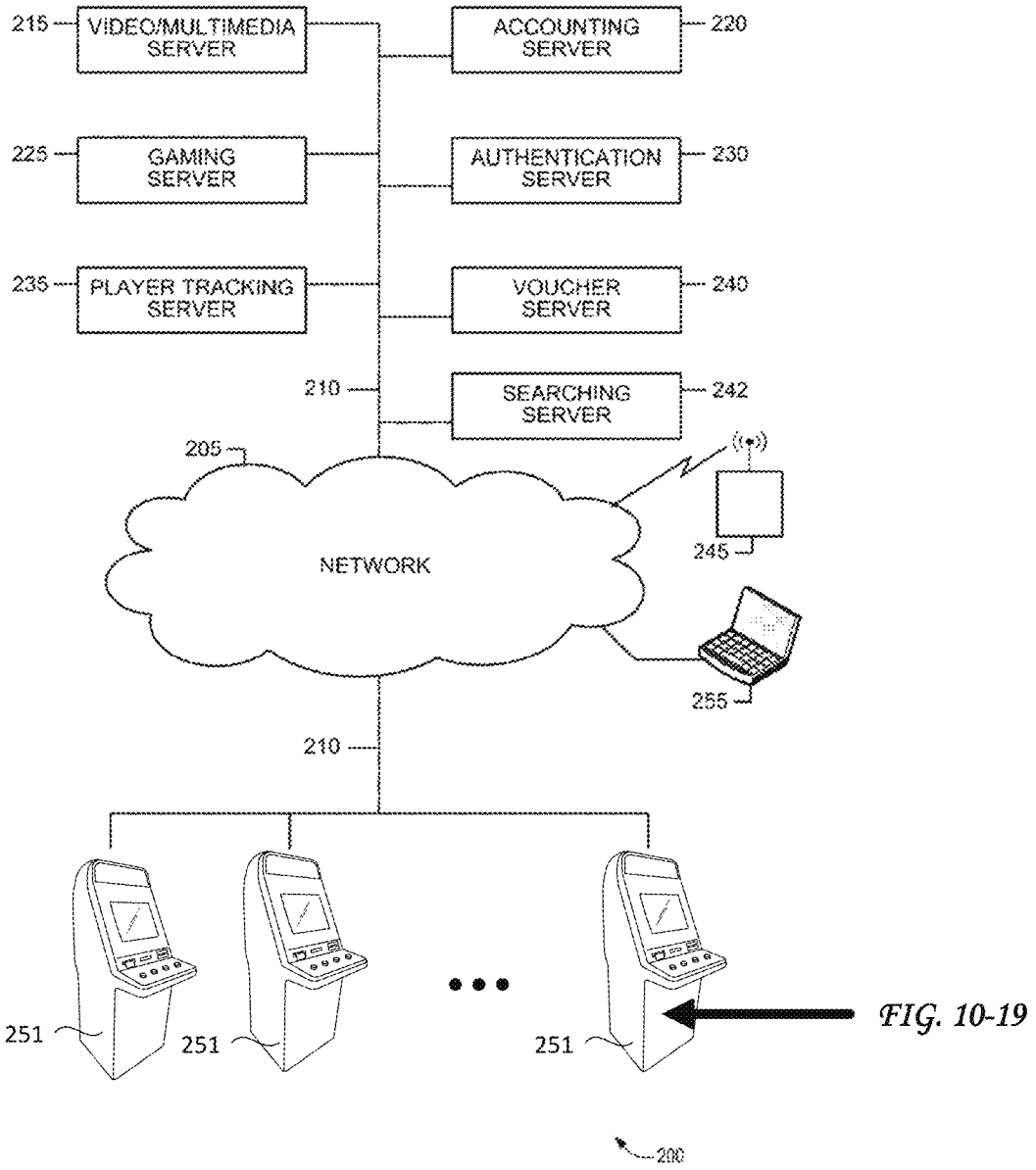
FIG. 2 shows a block diagram of an electronic gaming system according to one embodiment.

FIG. 2 shows an example block diagram of an electronic gaming system 200 according to one embodiment. As shown, electronic gaming system 200 may include electronic gaming devices (EGD) 251 (e.g., electronic gaming terminals, electronic gaming machines, wager-based video gaming machines, etc.), which may be coupled to network 205 via a network link 210. Network 205 may include the internet and/or a private network. One or more video streams may be received at video/multimedia server 215 from EGDs 251. Video/multimedia server 215 may also send one or more video streams to mobile devices 245, 255, EGDs 251, and/or other remote electronic devices. Video/multimedia server 215 may send these video streams via network link 210 and network 205.

Electronic gaming system 200 may include an accounting/transaction server 220, a gaming server 225, an authentication server 230, a player tracking server 235, a voucher server 240, and a searching server 242. The accounting/transaction server 220 may compile, track, store, and/or monitor cash flows, voucher transactions, winning vouchers, losing vouchers, and/or other transaction data for the casino operator and for the players. Transaction data may include the number of wagers, the size of these wagers, the date and time for these wagers, the identity of the players making these wagers, and the frequency of the wagers. Accounting/transaction server 220 may also generate tax information relating to these wagers, generate profit/loss and/or other reports for predetermined gaming options, contingent gaming options, predetermined betting structures, and/or outcome categories. Gaming server 225 may generate gaming options based on predetermined betting structures and/or outcome categories. These gaming options may be predetermined gaming options, contingent gaming options, and/or any other gaming option disclosed herein. The authentication server 230 may determine the validity of vouchers, players' identity, and/or an outcome for a gaming event. The player tracking server 235 may track a player's betting activity, a player's preferences such as the player's preferred language, drinks, font, sound level, and the like. Based on data obtained by player tracking server 235, a player may be eligible for gaming rewards (e.g., free play), promotions, and/or other awards (e.g., complimentary food, drinks, lodging, concerts, etc.). Voucher server 240 may generate a voucher, which may include data relating to gaming options. The generated vouchers may be physical (e.g., paper) or digital.

Searching server 242 may implement a search on one or more gaming devices to obtain gaming data. Searching server 242 may implement a messaging function, which may transmit a message to a third party (e.g., a player) relating to a search, a search status update, a game status update, a wager status update, a confirmation of a wager, a confirmation of a money transfer, and/or any other data relating to the player's account. The message can take the form of a text display on the gaming device, a pop-up window, a text message, an email, a voice message, a video message and the like. Searching server 242 may implement a wagering function, which may be an automatic wagering mechanism. These functions of searching server 242 may be integrated into one or more servers. Searching server 242 may be configured to, for example, determine which games paid out the most money during a time period, which games kept the most money from players during a time period, which games are most popular (e.g., top games), which games are least popular, which games have the most amount of money wager during a period, which games have the highest wager volume, which games are more volatile (e.g., volatility, or deviation from the statistical norms, of wager volume, wager amount, pay out, etc.) during a time period, and the like. Search may also be associated with location queries, time queries, and/or people queries.

According to embodiments, the gaming network 300 may include a display system server(s) 304 configured manage content (e.g., graphics, images, text, video fees, etc.) to be displayed and/or presented at one or more EGDs, dealer displays, administrator displays, etc. One or more EGD multimedia system server(s) 305 may be provided and coupled to network 310 and configured to manage content (e.g., graphics, images, text, video fees, audio feeds, etc.), which, for example, is to be streamed or provided to one or more EGDs (e.g., or to one or more groups of EGDs). One or more messaging system server(s) 306 may be provided and coupled to network 310 and configured for the management of messaging and/or other communications among and between the various systems, components, devices, EGDs, players, dealers, and administrators of the gaming network, mobile system server(s) 308 may manage communications and/or data exchanged with various types of mobile devices such as player-managed mobile devices (e.g., smart phones, PDAs, tablets, mobile computers), casino-managed mobile devices (e.g., mobile gaming devices), financial system server(s) 312 may be configured to track, manage, report and store financial data and financial transactions relating to one or more hybrid arcade/wager-based game sessions. According to one embodiment, a player tracking system server 314 may include at least one database that tracks each player's hands, wins/losses, bet amounts, player preferences, etc., in the network. In one implementation, the presenting and/or awarding of promotions, bonuses, rewards, achievements, etc., may be based on a player's play patterns, time, games selected, bet amount for each game type, etc. A player tracking system server may also help establish a player's preferences, which assists the casino in their promotional efforts to: award player comps (e.g., loyalty points); decide which promotion(s) are appropriate; generate bonuses and the like. Data tracking & analysis system(s) 318 may be configured to manage and analyze game data. In one embodiment, the data tracking & analysis system(s) may be configured to aggregate multisite hybrid arcade/wager-based gaming trends, local wins and jackpots.

Gaming system server(s) 322, 324 may each be dedicated to one or more specifically designated type(s) of game(s). Each game server may include game logic to host one of more virtual hybrid arcade/wager-based game sessions. At least some game server(s) may also be configured to track of the game accounting (e.g., money in, money out) for a virtual hybrid arcade/wager-based game being played, and/or for updating the financial system servers 312 at the end of each game. The game server(s) 322, 324 may also configured to generate the EGD graphics primitives (e.g., game virtual objects and game states), and may further be operable to update EGDs when a game state change (e.g., new card dealt, player upped the ante, player folds/busts, etc.) is detected. Jurisdictional/regulatory monitoring & enforcement system(s) 350 may be configured to handle tracking, monitoring, reporting, and enforcement of specific regulatory requirements relating to wager-based gameplay activities in one or more jurisdictions.

Authentication & validation system(s) 352 may be configured to determine and/or authenticate the identity of the current player at a given EGD. For example, in one embodiment, the current player may be required to perform a log in process at the EGD in order to access one or more features. Alternatively, the EGD may be adapted to automatically determine the identity of the current player based upon one or more external signals such as, for example, scanning of a barcode of a player tracking card, an RFID tag or badge worn by the current player which provides a wireless signal to the EGD for determining the identity of the current player. In at least one implementation, various security features may be incorporated into the EGD to prevent unauthorized players from engaging in certain types of activities at the EGD. In some embodiments, the authentication & validation system(s) 352 may be configured to authenticate and/or validate various types of hardware and/or software components, such as, for example, hardware/software components residing at a remote EGDs, game play information, wager information, player information and/or identity, etc.

Figure 3:
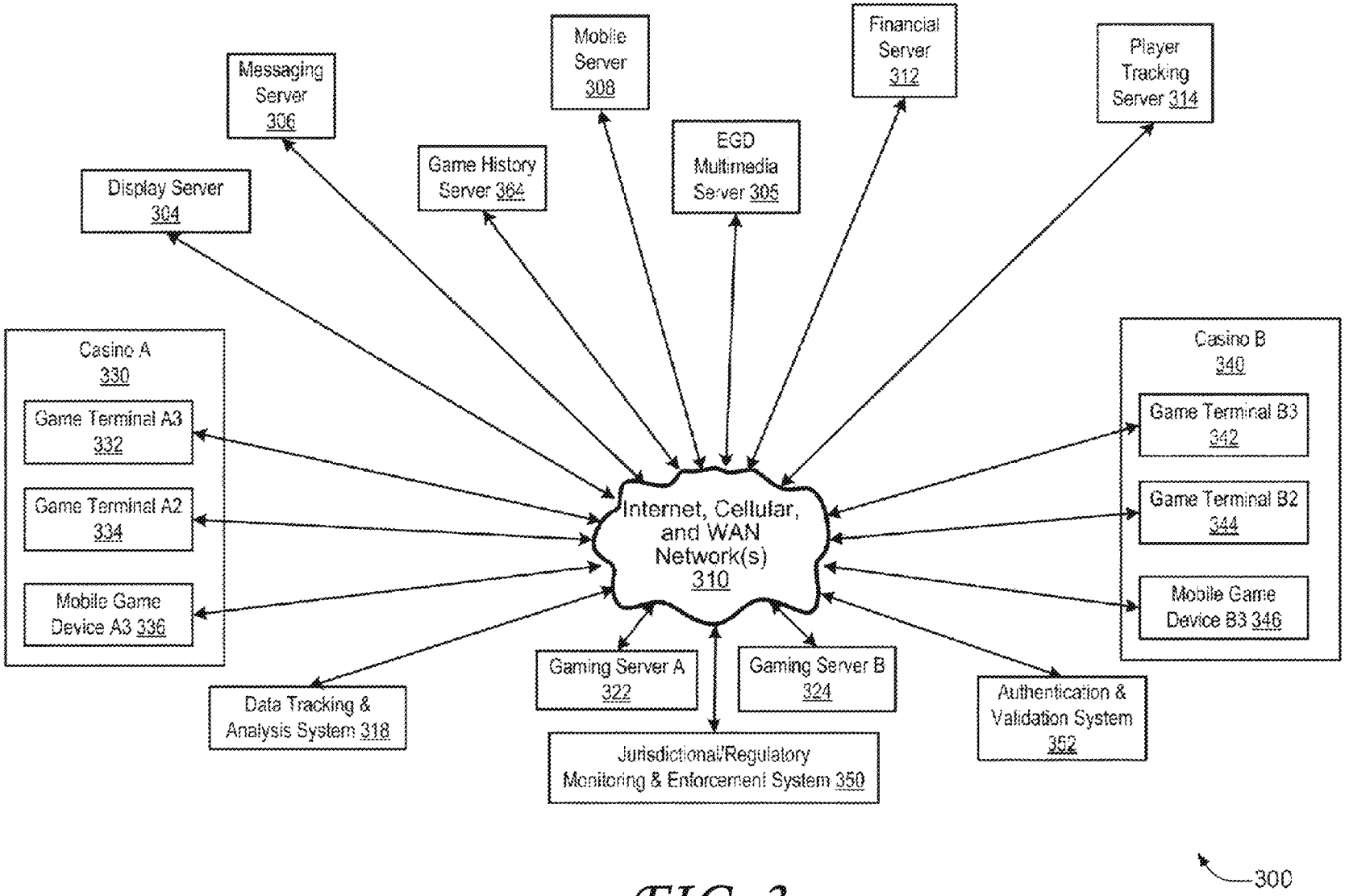
FIG. 3 illustrates a network diagram of gaming network that may be configured to implement embodiments described herein.

Casino venues, shown in FIG. 3 as Casino A 330 and Casino B 340, may correspond to a real-world, physical casino located at a particular geographic location. In some embodiments, a portion of the multiple different casino venues may be affiliated with one another (e.g., Harrah's Las Vegas, Harrah's London). In other embodiments, at least a portion of the multiple different casino venues do not share any affiliation with each other.

EGDs 332, 334, 336, 342, 344, 346 may be configured to enable players to participate in game sessions according to embodiments. Different EGDs may be physically located in one or more different casino venues and may be connected via a communication network such as shown at 310 in FIG. 3, which may include Internet, Cellular, and WAN Network(s). In some embodiments, EGDs may be implemented as stationary machines. In some embodiments, at least some EGDs may be implemented using mobile devices (e.g., tablets, smartphones, laptops, PC's, and the like).

Game history server(s) 364 may be provided. Game history servers 364 may be configured to track game types and game play history for hybrid arcade/wager-based games. In some embodiments, a game history server may also assist the casino manager in case of disputes between players and the casino by, for example, providing the ability to "replay" (e.g., by virtually recreating the game events) the game in dispute, step by step, based on previously stored game states. Remote database system(s) may be coupled to network 310 and selectively accessible and may be configured to store and provide access to various types of information and data described herein. Remote system server(s)/service(s) may be provided, and configured to provide, for example, content provider servers/services media streaming servers/services database storage/access/query servers/services, financial transaction servers/services, payment gateway servers/services, electronic commerce servers/services, event management/scheduling servers/services and/or other services. Mobile Game Device(s) 336, 346 may be configured to provide the services described below relative to FIG. 6.

According to specific embodiments, a variety of different game states may be used to characterize the state of current and/or past events which are occurring (e.g., or have occurred) at a given EGD. For example, in one embodiment, at any given time in a game, a valid current game state may be used to characterize the state of game play (e.g., and/or other related events, such as, for example, mode of operation of the EGD, etc.) at that particular time. In at least one embodiment, multiple different states may be used to characterize different states or events which occur at the EGD at any given time. In one embodiment, when faced with ambiguity of game state, a single state embodiment forces a decision such that one valid current game state is chosen. In a multiple state embodiment, multiple possible game states may exist simultaneously at any given time in a game, and at the end of the game or at any point in the middle of the game, the EGD may analyze the different game states and select one of them based on certain criteria. Thus, for example, when faced with ambiguity of game state, the multiple state embodiment(s) allow all potential game states to exist and move forward, thus deferring the decision of choosing one game state to a later point in the game. The multiple game state embodiment(s) may also be more effective in handling ambiguous data or game state scenarios.

A variety of different entities may be used (e.g., either singly or in combination) to track the progress of game states which occur at a given gaming EGD. Examples of such entities may include a master controller system, display system, gaming system, local game tracking component(s), remote game tracking component(s), etc. Examples of various game tracking components may include, but are not limited to: automated sensors, manually operated sensors, video cameras, intelligent playing card shoes, RFID readers/writers, RFID tagged chips, objects displaying machine readable code/patterns, etc.

Local game tracking components at the EGD may be operable to automatically monitor game play activities at the EGD, and/or to automatically identify key events which may trigger a transition of game state from one state to another as a game progresses. Depending upon the type of game being played at the gaming table, examples of possible key events may include the start of a new gaming session; the end of a current gaming session; the start of a virtual slot wheel spin; a game start event; a game end event; the detection of an event that triggers the initiation of wager-based event (e.g., killing a zombie, carrying out a predetermined action upon encountering a wagering opportunity, and the like); the detection of event that triggers the end of a wager-based event; the detection of event that triggers the initiation or end of a randomized game play event; an initial wager period start or end; a subsequent wager period start or end; or a payout period start or end.

Figure 4:
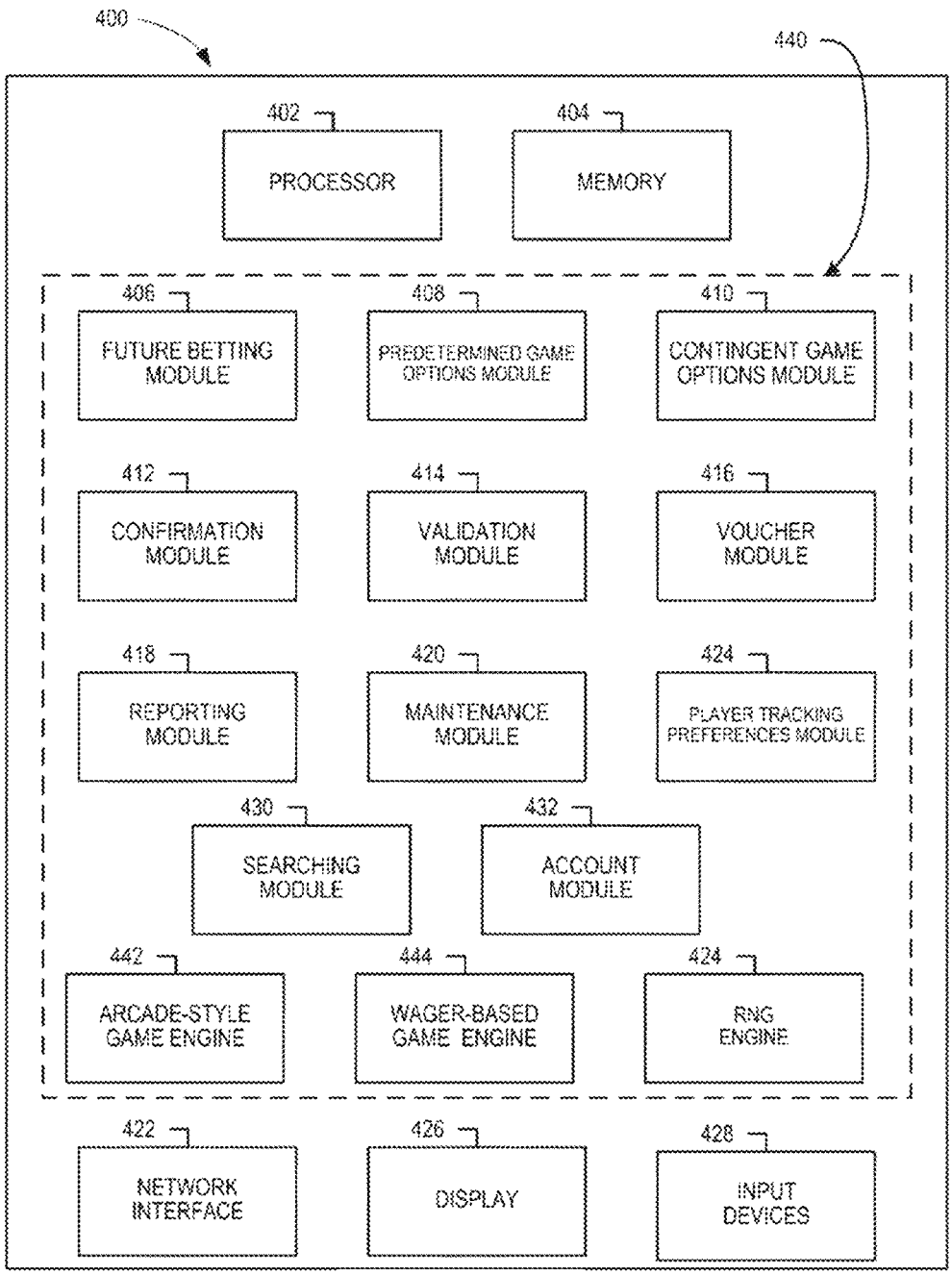
FIG. 4 is a block diagram of electronic gaming device, according to an embodiment.

FIG. 4 shows a block diagram 400 of electronic gaming device 400 according to one embodiment. As shown, electronic gaming device 400 may include a processor 402, a memory 404, a network interface 422, input devices 428, and a display 426. Processor 402 may generate gaming options based on predetermined betting structures and/or outcome categories. Predetermined betting structures may utilize more than one outcome category to generate via processor 402 gaming options. Predetermined betting structures may combine any outcome category with any other outcome category to gaming options. The processor 402 may offer a gaming option that is structured so that the gaming option relates to more than one EGD. Processor 402 may generate contingent gaming options and/or predetermined gaming options. Contingent gaming options 410 may be structures configured such that a wager is activated when a triggering event occurs.

Network interface 422 may be configured to enable the electronic gaming device 400 to communicate with remote devices/systems such as, for example, video/multimedia server(s), accounting/transaction server(s), gaming server(s), authentication server(s), player tracking server(s), voucher server(s) over a communication network, such as shown at 110, 205 and 310. Input devices 428 may be or include mechanical buttons, electronic buttons, one or more touchscreens, microphones, cameras, optical scanners, or any combination thereof. Input devices 428 may be utilized to make a wager, to make an offer to buy or sell a voucher, to determine a voucher's worth, to cash in a voucher, to modify (e.g., change sound level, configuration, font, language, etc.) electronic gaming device 400, to select a movie or music, to select type of content to be displayed on main and/or auxiliary screen(s) of EGD, or any combination thereof.

Arcade-style game engine 442 may be configured to manage the arcade-style game play portion (or entertainment portion) of the hybrid arcade/wager-based game. In contrast, a wager-based game engine 444 may be configured to manage the wager-based game event portion(s) of games according to embodiments. A Random Number Generator (RNG) Engine 446 may be provided and may include software and/or hardware algorithm and/or processes which are used to generate random outcomes and may be used by the wager-based game engine to generate wager-based game event outcomes.

Display 426 may show video streams from one or more gaming devices, gaming objects from one or more gaming devices, computer generated graphics, predetermined gaming options, and/or contingent gaming options. The memory 404 may include various memory modules 440, including a future betting module 406, a predetermined game options module 408, a contingent game options module 410, a confirmation module 412, a validation module 414, a voucher module 416, a reporting module 418, a maintenance module 420, a player tracking preferences module 424, a searching module 430, and an account module 432.

Future betting module 406 may store data relating to the predetermined betting structure. Processor 402 may utilize data in future betting module 406 to generate predetermined gaming options and/or contingent gaming options. Any other processor (e.g., gaming server 225, any virtualized gaming server, etc.) may implement the functions of processor 402. Predetermined game options module 408 may store data relating to predetermined gaming options, which may be offered to a player. The contingent game options module 410 may store data relating to contingent gaming options, which may be offered to a player. The confirmation module 412 may utilize data received from a voucher, the transaction history of the voucher (e.g., in the case in which the voucher changed hands in a secondary market), and/or the identity of the player to confirm the value of the voucher. In another example, confirmation module 412 may utilize game event data, along with voucher data to confirm the value of the voucher. A validation module 414 may utilize data received from a voucher to confirm the validity of the voucher. Voucher module 416 may store data relating to generated vouchers, redeemed vouchers, bought vouchers, and/or sold vouchers. Reporting module 418 may generate reports related to a performance of electronic gaming device 400, electronic gaming system(s), hybrid arcade/wager-based game(s), video streams, gaming objects, credit device(s) or identification device(s), for example.

In one implementation, reporting module 418 may reside on a central server and may be configured to aggregate and generate real time statistics on betting activities at one or more hybrid arcade/wager-based games at one or more participating casinos. The aggregate betting statistics may include trends (e.g., aggregate daily wager volume and wager amount by game types, by casinos, and the like), top games with the most payouts, top tables with the most payouts, top search structures used by players, most popular hybrid arcade/wager-based game(s) by wager volume, most searched for game, hybrid arcade/wager-based game(s) with least payouts, weekly trends, monthly trends, and other statistics related to game plays, wagers, people, location, and searches.

Maintenance module 420 may track any maintenance that is implemented on electronic gaming device 400 and/or electronic gaming system 200. Maintenance module 420 may schedule preventative maintenance and/or request a service call based on a device error. The player tracking preferences module 424 may compile and track data associated with a player's preferences.

Searching module 430 may include one or more searching structures, one or more searching algorithms, and/or any other searching mechanisms. In one example, the search may end once one or more triggering events are determined. In another example, the search may end once data has been received from a predetermined number (e.g., one, two, ten, one hundred, all) of the devices. In another example, the search may be based on a predetermined number of devices to be searched in combination with a predetermined number of search results to be obtained. In another example, the searching structures may be based on one or more specific games. In another example, the searching structure may be based on a player's preferences, past transactional history, player input, a particular hybrid arcade/wager-based game or game type, a particular EGD, a particular casino, a particular location within a casino, game outcomes over a time period, payout over a time period, and/or any other criteria. Searching algorithms may be dynamic searching programs, which may be modified based on one or more past results, as described previously. In another example, the search algorithm may generate a search priority based on the probability of success various events and/or conditions. In some embodiments, the search algorithm may utilize any dynamic feedback procedure to enhance current and/or future searching results.

Account module 432 may include data relating to an account balance, a wager limit, a number of wagers placed, credit limits, any other player information, and/or any other account information. Data from account module 432 may be utilized to determine whether a wager may be accepted. For example, when a search has determined a triggering event, the device and/or system may determine whether to allow this wager based on one or more of a wager amount, a number of wagers, a wager limit, an account balance, and/or any other criteria.

In at least one embodiment, at least a portion of the modules discussed in block diagram 400 may reside locally in gaming terminal 400. However, in at least some embodiments, at least part of the functions performed by these modules may be implemented in one or more remote servers. For instance, modules 406-420 and 424 may each be on a remote server, communicating with gaming terminal 400 via a network interface such as Ethernet in a local area network (LAN) or a wide area network (WAN) topology. In some implementations, these servers may be physical servers in a data center. In some other implementations, these servers may be virtualized. In yet some other implementations, the functions performed by these modules may be implemented as web services. For example, the predetermined game options module 408 may be implemented in software as a web service provider. Gaming terminal 400 would make service requests over the web for the available predetermined wager options to be displayed. Regardless of how the modules and their respective functions are implemented, the interoperability with the gaming terminal 400 is seamless. In one implementation, reporting module 418 may reside on a central server and may be configured to aggregate and generate real time statistics on betting activities at one or more hybrid arcade/wager-based games at one or more participating casinos. The aggregate betting statistics may include trends (e.g., aggregate daily wager volume and wager amount by game types, by casinos, and the like), top games with the most payouts, top EGDs with the most payouts, top search structures used by players, most popular hybrid arcade/wager-based game(s) by wager volume, most searched for game(s), EGDs with least payouts, weekly trends, monthly trends, and other statistics related to game plays, wagers, people, location, and searches.

Figure 5:
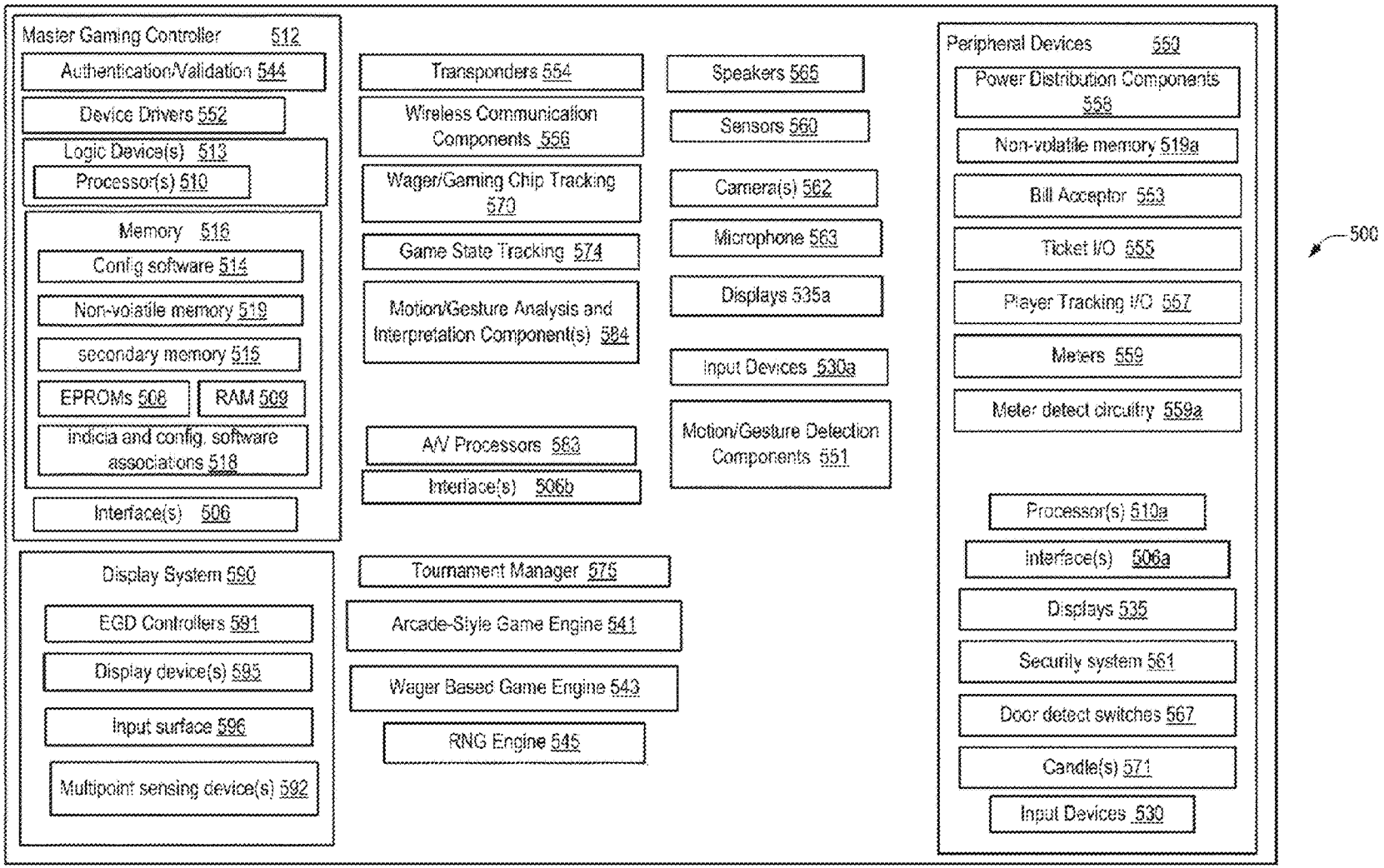
FIG. 5 is a block diagram of an intelligent electronic gaming system, according to one embodiment.

FIG. 5 is a block diagram of an exemplary intelligent multi-player electronic gaming system 500 according to one embodiment. Gaming system 500 may be implemented as a gaming server or as an electronic gaming machine (e.g., EGM) or electronic gaming device (e.g., EGD).

As shown, gaming system 500 may include at least one processor 510, at least one interface 506, and memory 516. Additionally, gaming system 500 may include at least one master gaming controller 512, a multi-touch sensor and display system 590, a plurality of peripheral device components 550, and various other components, devices, systems such as, for example, arcade-style game engine(s) 541; wager-based game engine(s) 543; RNG engine(s) 545; transponders 554; wireless communication components 556; gaming chip/wager token tracking components 570; games state tracking components 574; motion/gesture analysis and interpretation components 584, and audio/video processors 583 which, for example, may include functionality for detecting, analyzing and/or managing various types of audio and/or video information relating to various activities at the gaming system. Various interfaces **506*b* may be provided for communicating with other devices, components and systems, as may be tournament manager 575; sensors 560; one or more cameras 562; one or more microphones 563; secondary display(s) 535*a*; input devices 530*a*; motion/gesture detection components 551; and peripheral devices 550**.

The arcade-style game engine(s) 541 may be configured to manage the arcade-style game play portion (or entertainment portion) of the hybrid arcade/wager-based game. Conversely, the wager-based game engine(s) 543 may be configured to manage the wager-based game event portion(s) of the hybrid arcade/wager-based game. RNG engine(s) 545 may include software and/or hardware algorithm and/or processes used to generate random outcomes and may be used by the wager-based game engine to generate wager-based game event outcomes. Monetary payout manager 522 may be configured or designed to include functionality for determining the appropriate monetary payout(s) (if any) to be distributed to player(s) based on the outcomes of the wager-based game events which are initiated during play of one or more hybrid arcade/wager-based games. The non-monetary payout manager 524 may be configured to include functionality for determining the appropriate non-monetary payout(s) (if any) to be awarded or distributed to player(s) based on the outcomes of the wager-based game events which are initiated during play of one or more hybrid arcade/wager-based games.

One or more cameras (e.g., 562) may be used to monitor, stream and/or record image content and/or video content relating to persons or objects within each camera's view. For example, in at least one embodiment where the gaming system is implemented as an EGD, camera 562 may be used to generate a live, real-time video feed of a player (e.g., or other person) who is currently interacting with the EGD. In some embodiments, camera 562 may be used to verify a user's identity (e.g., by authenticating detected facial features), and/or may be used to monitor or tract facial expressions and/or eye movements of a user or player who is interacting with the gaming system.

In at least one embodiment, display system 590 may include EGD controllers 591; multipoint sensing device(s) 592 (e.g., multi-touch surface sensors/components); display device(s) 595; and Input/touch surface 596. According to embodiments, display surface(s) 595 may include one or more display screens. Master gaming controller 512 may include authentication/validation components 544; device drivers 552; logic devices 513, which may include one or more processors 510; memory 516, which may include configuration software 514, non-volatile memory 519, EPROMS 508, RAM 509, associations 518 between indicia and configuration software, and interfaces 506.

In at least one embodiment, the peripheral devices 550 may include power distribution components 558; non-volatile memory **519*a* (e.g., and/or other types of memory); bill acceptor 553; ticket I/O 555; player tracking I/O 557; meters 559 (e.g., hard and/or soft meters); meter detect circuitry 559*a*; processor(s) 510*a*; interface(s) 506*a*; display(s) 535; independent security system 561; door detect switches 567; candles, etc. 571; input devices 530**, for example.

In one implementation, processor 510 and master gaming controller 512 may be included in a logic device 513 enclosed in a logic device housing. The processor 510 may include any conventional processor or logic device configured to execute software (i.e., sequences of computer-readable instructions to be executed) allowing various tasks such as communicating with a remote source via communication interface 506, such as a server that stores authentication information or games; converting signals read by an interface to a format corresponding to that used by software or memory in the gaming system; accessing memory to configure or reconfigure game parameters in the memory according to indicia read from the device; communicating with interfaces, various peripheral devices and/or I/O devices; operating peripheral devices such as, for example, card readers, paper ticket readers, etc.; operating various I/O devices such as, for example, displays 535 and input devices 530. For instance, the processor 510 may send messages including game play information to the displays 535 to inform players of game play/event information, wagering information, and/or other desired information.

In at least one implementation, the gaming system may include card readers such as used with credit cards, or other identification code reading devices to allow or require player identification in connection with play of the card game and associated recording of game action. Such a player identification interface can be implemented in the form of a variety of magnetic and/or chip-card card readers commercially available for reading a player-specific identification information. The player-specific information can be provided on specially constructed magnetic cards issued by a casino, or magnetically coded credit cards or debit cards frequently used with national credit organizations such as Visa, MasterCard, American Express, or banks and other institutions.

The gaming system may include other types of participant identification mechanisms which may use a fingerprint image, eye blood vessel image reader, or other suitable biometric information to confirm identity of the player. Such personalized identification information could also be used to confirm credit use of a smart card, transponder, and/or player's personal player input device (e.g., UID).

The gaming system 500 also includes memory 516 which may include, for example, volatile memory (e.g., RAM 509), non-volatile memory 519 (e.g., disk memory, FLASH memory, EPROMs, etc.), unalterable memory (e.g., EPROMs 508), etc. The memory may be configured or designed to store, for example: 1) configuration software 514 such as all the parameters and settings for a game playable on the gaming system; 2) associations 518 between configuration indicia read from a device with one or more parameters and settings; 3) communication protocols allowing the processor 510 to communicate with peripheral devices and I/O devices 4) a secondary memory storage device 515 such as a non-volatile memory device, configured to store gaming software related information (e.g., the gaming software related information and memory may be used to store various audio files and games not currently being used and invoked in a configuration or reconfiguration); 5) communication transport protocols (e.g., such as, for example, TCP/IP, USB, Firewire, IEEE1394, Bluetooth, IEEE 802.11x (e.g., IEEE 802.11 standards), hiperlan/2, HomeRF, etc.) for allowing the gaming system to communicate with local and non-local devices using such protocols; etc. In one implementation, the master gaming controller 512 communicates using a serial communication protocol. A few examples of serial communication protocols that may be used to communicate with the master gaming controller include but are not limited to USB, RS-232 and Netplex (e.g., a proprietary protocol developed by IGT, Reno, Nev.).

A plurality of device drivers 552 may be stored in memory 516. Example of different types of device drivers may include device drivers for gaming system components, device drivers for gaming system components, etc. The device drivers 552 may utilize a communication protocol of some type that enables communication with a particular physical device. The device driver abstracts the hardware implementation of a device. For example, a device driver may be written for each type of card reader that may be potentially connected to the gaming system. Examples of communication protocols used to implement the device drivers include Netplex, USB, Serial, Ethernet, Firewire, I/O debouncer, direct memory map, serial, PCI, parallel, RF, Bluetooth™, near-field communications (e.g., using near-field magnetics), 802.11 (e.g., Wi-Fi), etc. When one type of a particular device is exchanged for another type of the particular device, a new device driver may be loaded from the memory 516 by the processor 510 to allow communication with the device. For instance, one type of card reader in gaming system 500 may be replaced with a second type of card reader where device drivers for both card readers are stored in the memory 516.

The software units stored in the memory 516 may be upgraded as needed. For instance, when the memory 516 is a hard drive, new games, game options, various new parameters, new settings for existing parameters, new settings for new parameters, device drivers, and new communication protocols may be uploaded to the memory from the master gaming controller 512 or from some other external device. As another example, when the memory 516 includes a CD/DVD drive including a CD/DVD designed or configured to store game options, parameters, and settings, the software stored in the memory may be upgraded by replacing a second CD/DVD with a second CD/DVD. In yet another example, when the memory 516 uses one or more flash memory 519 or EPROM 508 units designed or configured to store games, game options, parameters, settings, the software stored in the flash and/or EPROM memory units may be upgraded by replacing one or more memory units with new memory units which include the upgraded software. One or more of the memory devices, such as the hard-drive, may be employed in a game software download process from a remote software server.

The gaming system 500 may also include various authentication and/or validation components 544 which may be used for authenticating/validating specified gaming system components such as, for example, hardware components, software components, firmware components, information stored in the gaming system memory 516, etc.

Sensors 560 may include, for example, optical sensors, pressure sensors, RF sensors, Infrared sensors, motion sensors, audio sensors, image sensors, thermal sensors, biometric sensors, etc. As mentioned previously, such sensors may be used for a variety of functions such as, for example: detecting the presence and/or monetary amount of gaming chips which have been placed within a player's wagering zone and/or detecting (e.g., in real time) the presence and/or monetary amount of gaming chips which are within the player's personal space, for example. In one implementation, at least a portion of the sensors 560 and/or input devices 530 may be implemented in the form of touch keys selected from a wide variety of commercially available touch keys used to provide electrical control signals. Alternatively, some of the touch keys may be implemented by a touch-screen display. For example, in at least one implementation, the gaming system player may include input functionality for enabling players to provide their game play decisions/instructions (e.g., and/or other input) to the EGD using the touch keys and/or other player control sensors/buttons. Additionally, such input functionality may also be used for allowing players to provide input to other devices in the casino gaming network (e.g., such as, for example, player tracking systems, side wagering systems, etc.)

Wireless communication components 556 may include one or more communication interfaces having different architectures and utilizing a variety of protocols such as, for example, 802.11 (e.g., Wi-Fi), 802.15 (e.g., including Bluetooth™), 802.16 (e.g., WiMAX), 802.22, Cellular standards such as CDMA, CDMA2000, WCDMA, Radio Frequency (e.g., RFID), Infrared, Near Field Magnetic communication protocols, etc. The communication links may transmit electrical, electromagnetic or optical signals which carry digital data streams or analog signals representing various types of information. An example of a near-field communication protocol is the ECMA-340 "Near Field Communication—Interface and Protocol (e.g., NFCIP-1)", published by ECMA International (e.g., www.ecma-international.org), herein incorporated by reference in its entirety for all purposes. It will be appreciated that other types of Near Field Communication protocols may be used including, for example, near field magnetic communication protocols, near field RF communication protocols, and/or other wireless protocols which provide the ability to control with relative precision (e.g., on the order of centimeters, inches, feet, meters, etc.) the allowable radius of communication between at least 5 devices using such wireless communication protocols.

Power distribution components 558 may include, for example, components or devices which are operable for providing wireless power to other devices. For example, in one implementation, the power distribution components 558 may include a magnetic induction system which is adapted to provide wireless power to one or more portable UIDs at the gaming system. In one implementation, a UID docking region may include a power distribution component which is able to recharge a UID placed within the UID docking region without requiring metal-to-metal contact.

A motion/gesture detection component(s) 551 may be configured or designed to detect player movements and/or gestures and/or other input data from the player. In some implementations, each gaming system may have its own respective motion/gesture detection component(s). In other embodiments, motion/gesture detection component(s) 551 may be implemented as a separate sub-system of the gaming system which is not associated with any one specific gaming system or device.

Figure 6:
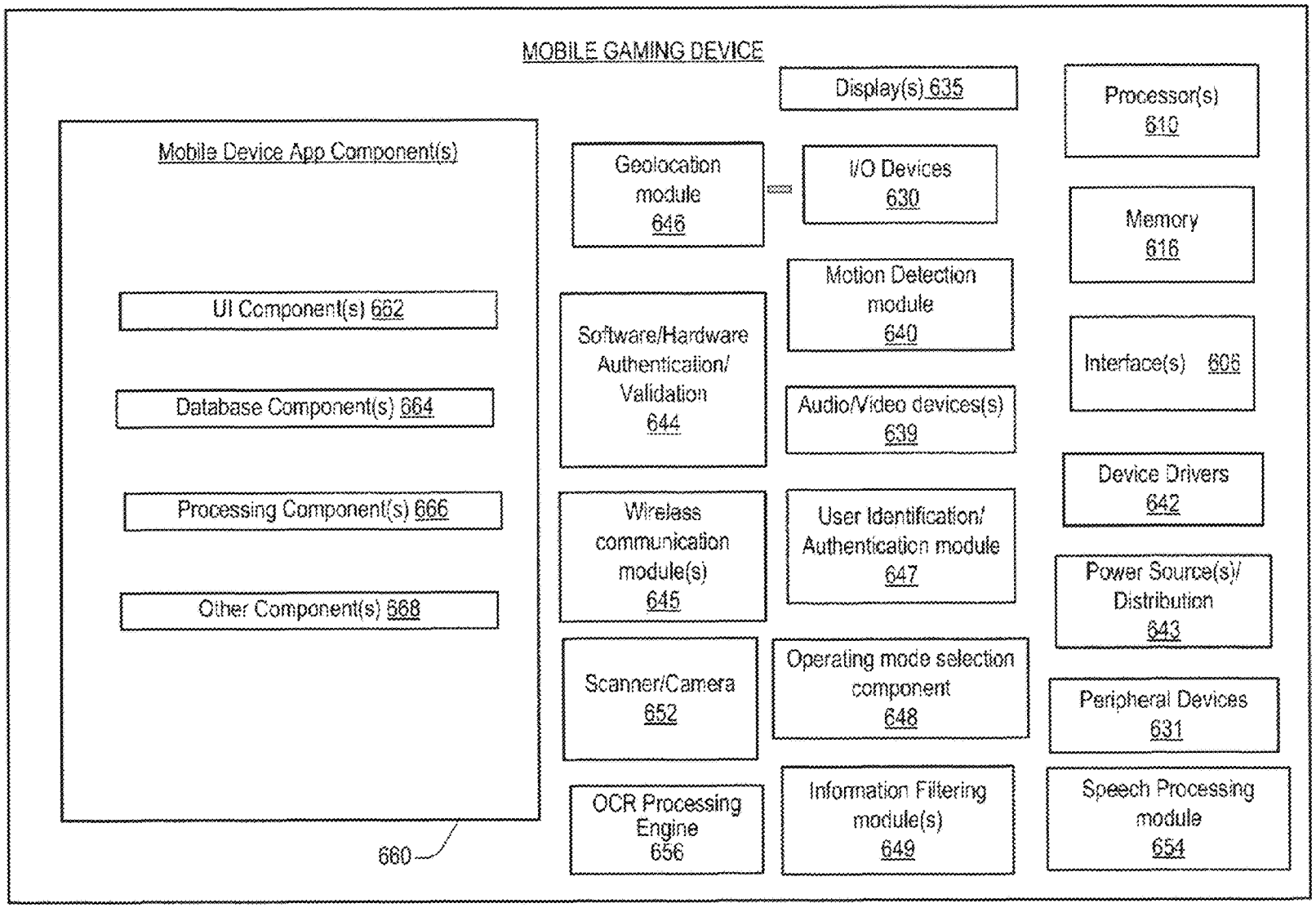
FIG. 6 is a block diagram of a mobile gaming device with which an embodiment may be practiced.

FIG. 6 is a block diagram of an exemplary mobile gaming device 600 in accordance with a specific embodiment. In at least one embodiment, one or more players may participate in a game session using mobile gaming devices. In at least some embodiments, the mobile gaming device may be configured or designed to include or provide functionality which is similar to that of an electronic gaming device (e.g., EGD) such as that described, for example, in FIG. 4.

As shown in FIG. 6, mobile gaming device 600 may include mobile device application components (e.g., 660), which, for example, may include UI components 662; database components 664; processing components 666 and/or other components 668 which, for example, may include components for facilitating and/or enabling the mobile gaming device to carry out the functionality described herein.

The mobile gaming device 600 may include mobile device app component(s) that have been configured or designed to provide functionality for enabling or implementing at least a portion of the functionality of the hybrid arcade/wager-based game techniques at the mobile gaming device.

According to embodiments, various aspects, features, and/or functionalities of the mobile gaming device may be performed, implemented and/or initiated by processor(s) 610; device drivers 642; memory 616; interface(s) 606; power source(s)/distribution 643; geolocation module 646; display(s) 635; I/O devices 630; audio/video devices(s) 639; peripheral devices 631; motion detection module 640; user identification/authentication module 647; client app component(s) 660; other component(s) 668; UI Component(s) 662; database component(s) 664; processing component(s) 666; software/hardware authentication/validation 644; wireless communication module(s) 645; information filtering module(s) 649; operating mode selection component 648; speech processing module 654; scanner/camera 652 and/or OCR processing engine 656, for example.

Figure 7:
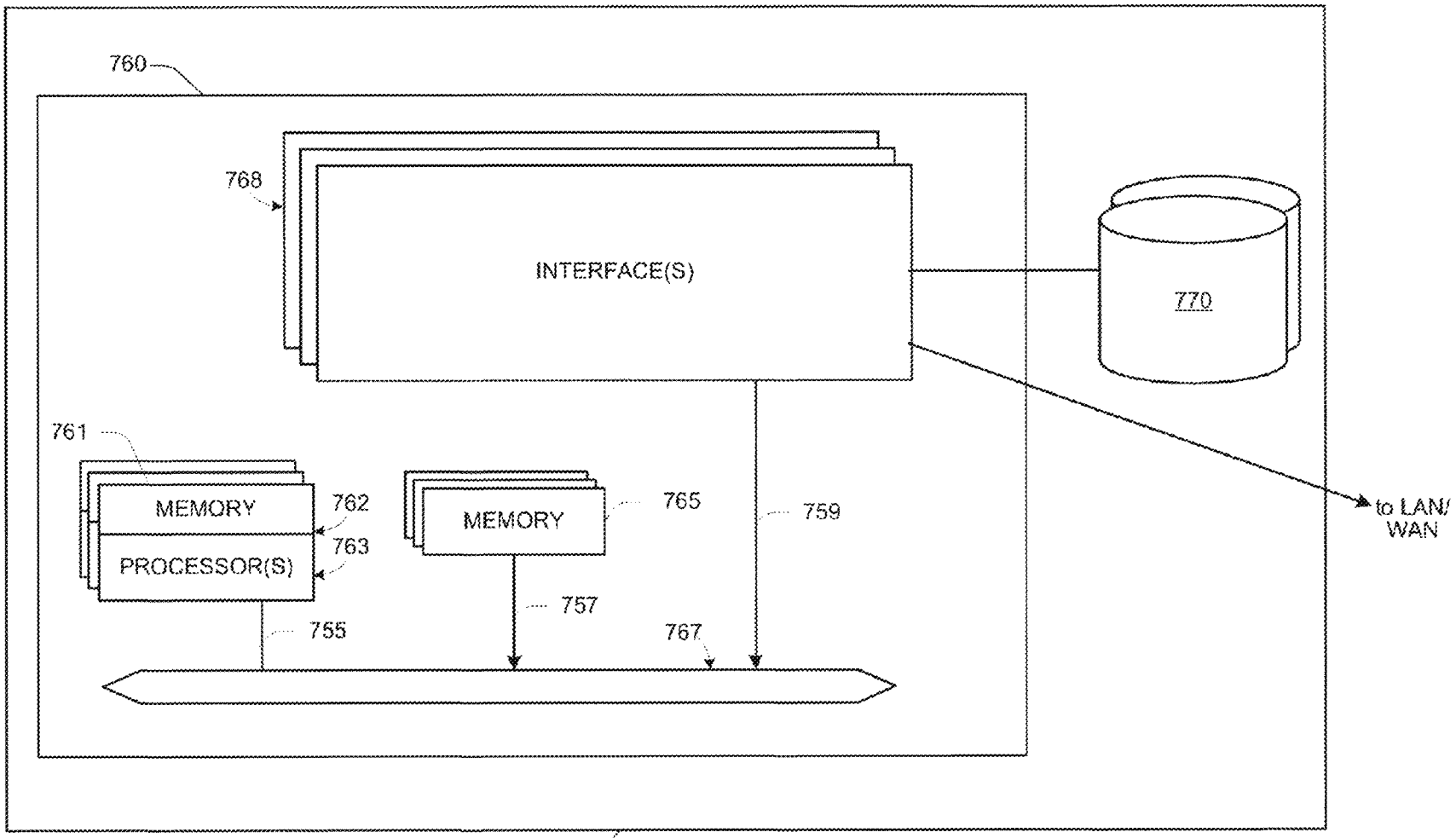
FIG. 7 shows a system server suitable for implementing various aspects of embodiments described herein.

FIG. 7 shows a system server 780 that may be configured according to embodiments. The system server 780 may include at least one network device 760, and at least one storage device 770 (e.g., such as, for example, a direct attached storage device). In one embodiment, system server 780 may be configured to implement at least some of the hybrid arcade/wager-based game techniques described herein. Network device 760 may include a master central processing unit (e.g., CPU) 762, interfaces 768, and a bus 767 (e.g., a PCI bus). When acting under the control of appropriate software or firmware, the CPU 762 may be responsible for implementing specific functions associated with the functions of a desired network device. For example, when configured as a server, the CPU 762 may be responsible for analyzing packets; encapsulating packets; forwarding packets to appropriate network devices; instantiating various types of virtual machines, virtual interfaces, virtual storage volumes, virtual appliances; etc. The CPU 762 preferably accomplishes at least a portion of these functions under the control of software including an operating system (e.g., Linux), and any appropriate system software (e.g., such as, for example, AppLogic (e.g., ™) software).

CPU 762 may include one or more processors 763 such as, for example, one or more processors from the AMD, Motorola, Intel and/or MIPS families of microprocessors. In an alternative embodiment, processor 763 may be specially designed hardware for controlling the operations of system server 780. In a specific embodiment, a memory 761 (e.g., such as non-volatile RAM and/or ROM) also forms part of CPU 762. However, there are different ways in which memory could be coupled to the system. Memory block 761 may be used for a variety of purposes such as, for example, caching and/or storing data, programming instructions, etc.

Interfaces 768 may be typically provided as interface cards. Alternatively, one or more of the interfaces 768 may be provided as on-board interface controllers built into the system motherboard. Generally, they control the sending and receiving of data packets over the network and sometimes support other peripherals used with the system server 780. Among the interfaces that may be provided may be FC interfaces, Ethernet interfaces, frame relay interfaces, cable interfaces, DSL interfaces, token ring interfaces, InfiniBand interfaces, and the like. In addition, various very high-speed interfaces may be provided, such as fast Ethernet interfaces, Gigabit Ethernet interfaces, ATM interfaces, HSSI interfaces, POS interfaces, FDDI interfaces, ASI interfaces, DHEI interfaces and the like. Other interfaces may include one or more wireless interfaces such as, for example, 802.11 (e.g., Wi-Fi) interfaces, 802.15 interfaces (e.g., including Bluetooth™) 802.16 (e.g., WiMAX) interfaces, 802.22 interfaces, Cellular standards such as CDMA interfaces, CDMA2000 interfaces, WCDMA interfaces, TDMA interfaces, Cellular 3G interfaces, and the like.

Generally, one or more interfaces may include ports appropriate for communication with the appropriate media. In some cases, they may also include an independent processor and, in some instances, volatile RAM. The independent processors may control such communications intensive tasks as packet switching, media control and management. By providing separate processors for the communications intensive tasks, these interfaces allow the master microprocessor 762 to efficiently perform routing computations, network diagnostics or security functions.

In at least one embodiment, some interfaces may be configured or designed to allow the system server 780 to communicate with other network devices associated with various local area network (e.g., LANs) and/or wide area networks (e.g., WANs). Other interfaces may be configured or designed to allow network device 760 to communicate with one or more direct attached storage device(s) 770.

Regardless of network device's configuration, it may employ one or more memories or memory modules (e.g., such as, for example, memory block 765, which, for example, may include random access memory (e.g., RAM)) configured to store data, program instructions, logic and processes for the general-purpose network operations and/or other information relating to the functionality of the embodiments described herein. The program instructions may control the operation of an operating system and/or one or more applications, for example. The memory or memories may also be configured to store data structures, and/or other specific non-program information described herein.

Because such information and program instructions may be employed to implement the systems/methods described herein, one or more embodiments relates to machine readable media that include program instructions, state information, etc. for performing various operations described herein. Examples of machine-readable storage media include, but are not limited to, magnetic media such as hard disks, floppy disks, and magnetic tape; optical media such as CD-ROM disks; magneto-optical media such as floptical disks; and hardware devices that may be specially configured to store and perform program instructions, such as read-only memory devices (e.g., ROM) and random-access memory (e.g., RAM). Some embodiments may also be embodied in transmission media such as, for example, a carrier wave travelling over an appropriate medium such as airwaves, optical lines, electric lines, etc. Examples of program instructions include both machine code, such as produced by a compiler, and files containing higher level code that may be executed by the computer using an interpreter.

Figure 8:
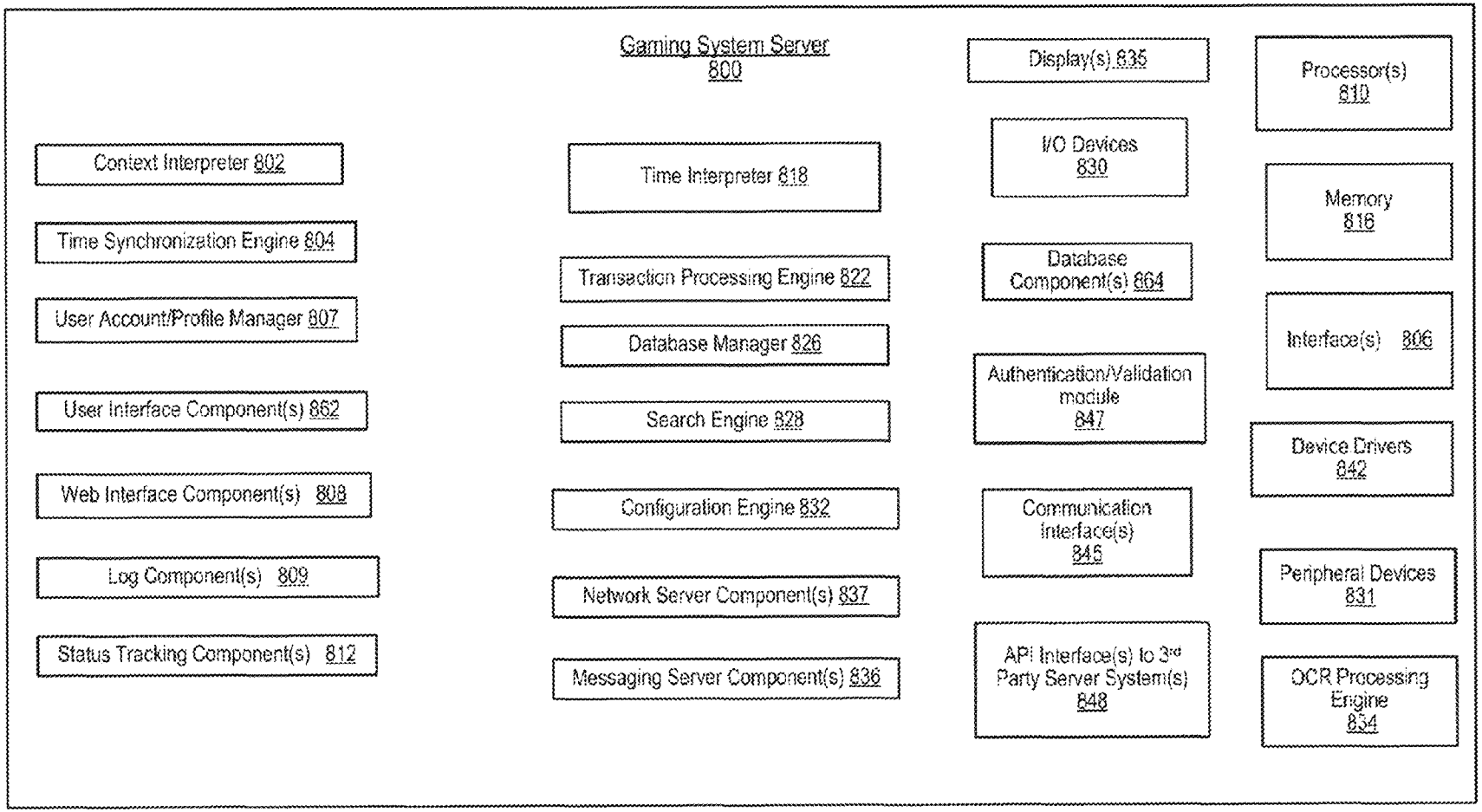
FIG. 8 shows a functional block diagram of a gaming system server according to one embodiment.

FIG. 8 illustrates an example of a functional block diagram of a gaming system server in accordance with a specific embodiment. As shown, the gaming system server 800 may a context interpreter 802 which, for example, may be operable to automatically and/or dynamically analyze contextual criteria relating to a detected set of event(s) and/or condition(s), and automatically determine or identify one or more contextually appropriate response(s) based on the contextual interpretation of the detected event(s)/condition(s). Examples of contextual criteria which may be analyzed may include, but are not limited to, for example, location-based criteria (e.g., geolocation of mobile gaming device, geolocation of EGD, time-based criteria, identity of user(s), user profile information, transaction history information and recent user activities, for example. Time synchronization engine 804 may be operable to manage universal time synchronization (e.g., via NTP and/or GPS). The search engine 828 may be operable to search for transactions, logs, game history information, player information, hybrid arcade/wager-based game information, etc., which may be accessed from one or more local and/or remote databases. The gaming system server 800 may also include a configuration engine 832 that may be configured to determine and handle configuration of various customized configuration parameters for one or more devices, component(s), system(s), and process(es). Time interpreter 818 may be operable to automatically and/or dynamically modify or change identifier activation and expiration time(s) based on various criteria such as, for example, time, location, transaction status, etc. Authentication/validation component(s) 847 (e.g., password, software/hardware info, SSL certificates) may be operable to perform various types of authentication/validation tasks. The transaction processing engine 822 may be operable to handle various types of transaction processing tasks such as, described and/or referenced herein. An OCR processing engine 834 may be operable to perform image processing and optical character recognition of images such as those captured by a gaming device camera, for example. The database manager 826 may be configured to handle various types of tasks relating to database updates, management and access. In at least one embodiment, the database manager may be operable to manage game history databases, player tracking databases and/or other historical record keeping. Log component(s) 809 may be operable to generate and manage transactions history logs, system errors, connections from APIs. Status tracking component(s) 812 may be provided and configured to automatically and/or dynamically determine, assign, and/or report updated transaction status information based, for example, on a state of the transaction. Gateway component(s) may be operable to facilitate and manage communications and transactions with external payment gateways. Web interface component(s) 808 may be operable to facilitate and manage communications and transactions with virtual live electronic gaming device web portal(s). API interface(s) to gaming system server(s) may be operable to facilitate and manage communications and transactions with API Interface(s) to the gaming system server(s). API Interface(s) to 3rd party system server(s) may be provided, which may be operable to facilitate and manage communications and transactions with API interface(s) to 3rd party system server(s).

One or more general-purpose processors 810 may be provided. In an alternative embodiment, at least one processor may be specially designed hardware for controlling the operations of a gaming system. In a specific embodiment, a memory (e.g., such as non-volatile RAM and/or ROM) also forms part of CPU. When acting under the control of appropriate software or firmware, the CPU may be responsible for implementing specific functions associated with the functions of a desired network device. The CPU preferably accomplishes all these functions under the control of software including an operating system, and any appropriate applications software. Memory 816 may be provided. The memory 816 may include volatile memory (e.g., RAM), non-volatile memory (e.g., disk memory, FLASH memory, EPROMs, etc.), unalterable memory, and/or other types of memory. According to different embodiments, one or more memories or memory modules (e.g., memory blocks) may be configured or designed to store data, program instructions for the functional operations of the mobile gaming system and/or other information. The program instructions may control the operation of an operating system and/or one or more applications, for example. The memory or memories may also be configured to store data structures, metadata, identifier information/images, and/or information/data relating to other features/functions described herein. Interface(s) 806 may be provided such as, for example, wired interfaces and/or wireless interfaces. Suitable device driver(s) 842 may also be provided, as may be one or more display(s) 835. Messaging server component(s) 836, may provide various functions and operations relating to messaging activities and communications. Similarly, network server component(s) 837 may be configured to provide various functions and operations relating to network server activities and communications. User account/profile manager component(s) 807 may be provided to manage various aspects of user accounts and/or profiles.

Figure 9:
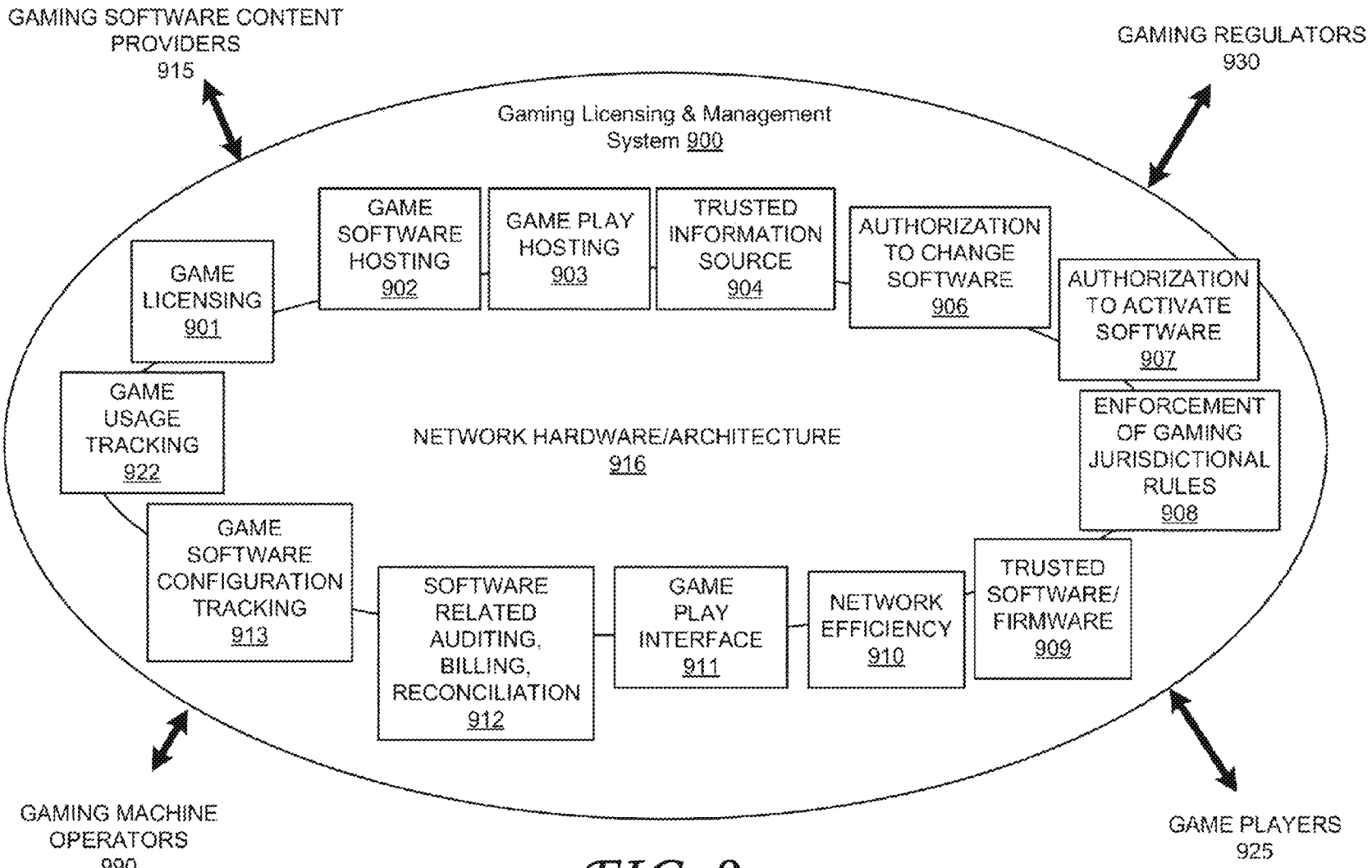
FIG. 9 shows a block diagram illustrating components of a gaming system suitable for implementing an embodiment.

FIG. 9 shows a block diagram illustrating components of a gaming system 900 suitable for implementing various aspects of the embodiments shown and described herein. In FIG. 9, the components of a gaming system 900 for providing game software licensing and downloads are described functionally. The described functions may be instantiated in hardware, firmware and/or software and executed on a suitable device. In the system 900, there may be many instances of the same function, such as multiple game play interfaces 911. Nevertheless, in FIG. 9, only one instance of each function is shown. The functions of the components may be combined. For example, a single device may comprise the game play interface 911 and include trusted memory devices or sources 909.

The gaming system 900 may receive inputs from different groups/entities and output various services and or information to these groups/entities. For example, game players 925 primarily input cash or indicia of credit into the system, make game selections that trigger software downloads, and receive entertainment in exchange for their inputs. Game software content providers provide game software for the system and may receive compensation for the content they provide based on licensing agreements with the gaming machine operators. Gaming machine operators select game software for distribution, distribute the game software on the gaming devices in the system 900, receive revenue for the use of their software and compensate the gaming machine operators. The gaming regulators 930 provide rules and regulations that are applicable to the gaming system and receive reports and other information confirming adherence to these rules.

The game software license host 901 may be a server connected to a number of remote gaming devices that provides licensing services to the remote gaming devices. For example, the license host 901 may 1) receive token requests for tokens used to activate software executed on the remote gaming devices, 2) send tokens to the remote gaming devices, 3) track token usage and 4) grant and/or renew software licenses for software executed on the remote gaming devices. The token usage may be used in use-based licensing schemes, such as a pay-per-use scheme.

In another embodiment, a game usage-tracking host 922 may track the usage of game software on a plurality of devices in communication with the host. The game usage-tracking host 922 may be in communication with a plurality of game play hosts and gaming machines. From the game play hosts and gaming machines, the game usage tracking host 922 may receive updates of an amount that each game available for play on the devices may be played and on amount that may be wagered per game. This information may be stored in a database and used for billing according to methods described in a utility-based licensing agreement.

The game software host 902 may provide game software downloads, such as downloads of game software or game firmware, to various devices in the game system 900. For example, when the software to generate the game is not available on the game play interface 911, the game software host 902 may download software to generate a selected game of chance played on the game play interface. Further, the game software host 902 may download new game content to a plurality of gaming machines responsive to a request from a gaming machine operator.

The game software host 902 may also include a game software configuration-tracking host 913. The function of the game software configuration-tracking host is to keep records of software configurations and/or hardware configurations for a plurality of devices in communication with the host (e.g., denominations, number of paylines, payout schedules, max/min wagers).

A game play host device 903 may include a host server connected to a plurality of remote clients that generates games of chance that are displayed on a plurality of remote game play interfaces 911. For example, the game play host device 903 may include a server that provides central determination of wager outcomes on a plurality of connected game play interfaces 911. As another example, the game play host device 903 may generate games of chance, such as slot games or wager-based video games, for display on a remote client. A game player using the remote client may be able to select from a number of games that are provided on the client by the host device 903. The game play host device 903 may receive game software management services, such as receiving downloads of new game software, from the game software host 902 and may receive game software licensing services, such as the granting or renewing of software licenses for software executed on the device 903, from the game license host 901.

The game play interfaces or other gaming devices in the gaming system 900 may be portable devices, such as electronic tokens, cell phones, smart cards, tablet PCs and PDAs. The portable devices may support wireless communications. The network hardware architecture 916 may be enabled to support communications between wireless mobile devices and other gaming devices in gaming system. The wireless mobile devices may be used to play games of chance, such as described herein.

The gaming system 900 may use a number of trusted information sources. Trusted information sources 904 may include devices, such as servers, that provide information used to authenticate/activate other pieces of information. Cyclic Redundancy Check (CRC) values used to authenticate software, license tokens used to allow the use of software or product activation codes used to activate software are examples of trusted information that might be provided from a trusted information source 904. Trusted information sources may include a memory device, such as an EPROM, that includes trusted information used to authenticate other information. For example, a game play interface 911 may store a private encryption key in a trusted memory device that is used in a private key-public key encryption scheme to authenticate information from another gaming device.

Gaming devices storing trusted information might utilize apparatus or methods to detect and prevent tampering. For instance, trusted information stored in a trusted memory device may be encrypted to prevent its misuse. In addition, the trusted memory device may be secured behind a locked door. Further, one or more sensors may be coupled to the memory device to detect tampering with the memory device and provide some record of the tampering. In yet another example, the memory device storing trusted information might be designed to detect tampering attempts and clear or erase itself when an attempt at tampering may be detected.

The gaming system 900 of example embodiments may include devices 906 that provide authorization to download software from a second device to a second device and devices 907 that provide activation codes or information that allow downloaded software to be activated. The devices, 906 and 907, may be remote servers and may also be trusted information sources.

A device 906 that monitors a plurality of gaming devices to determine adherence of the devices to gaming jurisdictional rules 908 may be included in the system 900. A gaming jurisdictional rule server may scan software and the configurations of the software on a number of gaming devices in communication with the gaming rule server to determine whether the software on the gaming devices is valid for use in the gaming jurisdiction where the gaming device is located. For example, the gaming rule server may request a digital signature, such as CRCs, of particular software components and compare them with an approved digital signature value stored on the gaming jurisdictional rule server.

Further, the gaming jurisdictional rule server may scan the remote gaming device to determine whether the software is configured in a manner that is acceptable to the gaming jurisdiction where the gaming device is located. For example, a maximum wager limit may vary from jurisdiction to jurisdiction and the rule enforcement server may scan a gaming device to determine its current software configuration and its location and then compare the configuration on the gaming device with approved parameters for its location.

A gaming jurisdiction may include rules that describe how game software may be downloaded and licensed. The gaming jurisdictional rule server may scan download transaction records and licensing records on a gaming device to determine whether the download and licensing was carried out in a manner that is acceptable to the gaming jurisdiction in which the gaming device is located. In general, the game jurisdictional rule server may be utilized to confirm compliance to any gaming rules passed by a gaming jurisdiction when the information needed to determine rule compliance is remotely accessible to the server.

Game software, firmware or hardware residing a particular gaming device may also be used to check for compliance with local gaming jurisdictional rules. When a gaming device is installed in a particular gaming jurisdiction, a software program including jurisdiction rule information may be downloaded to a secure memory location on a gaming machine or the jurisdiction rule information may be downloaded as data and utilized by a program on the gaming machine. The software program and/or jurisdiction rule information may check the gaming device software and software configurations for compliance with local gaming jurisdictional rules. In another embodiment, the software program for ensuring compliance and jurisdictional information may be installed in the gaming machine prior to its shipping, such as at the factory where the gaming machine is manufactured.

The gaming devices in game system 900 may utilize trusted software and/or trusted firmware. Trusted firmware/software is trusted in the sense that is used with the assumption that it has not been tampered with. For instance, trusted software/firmware may be used to authenticate other game software or processes executing on a gaming device. As an example, trusted encryption programs and authentication programs may be stored on an EPROM on the gaming machine or encoded into a specialized encryption chip. As another example, trusted game software, e.g., game software approved for use on gaming devices by a local gaming jurisdiction may be required on gaming devices on the gaming machine.

The devices may be connected by a network 916 with different types of hardware using different hardware architectures. Game software can be quite large and frequent downloads can place a significant burden on a network, which may slow information transfer speeds on the network. For game-on-demand services that require frequent downloads of game software in a network, efficient downloading is essential for the service to viable. Thus, network efficient devices 910 may be used to actively monitor and maintain network efficiency. For instance, software locators may be used to locate nearby locations of game software for peer-to-peer transfers of game software. In another example, network traffic may be monitored, and downloads may be actively rerouted to maintain network efficiency.

One or more devices may provide game software and game licensing related auditing, billing and reconciliation reports to server 912. For example, a software licensing billing server may generate a bill for a gaming device operator based upon a usage of games over a time period on the gaming devices owned by the operator. In another example, a software auditing server may provide reports on game software downloads to various gaming devices in the gaming system 900 and current configurations of the game software on these gaming devices.

At particular time intervals, the software auditing server 912 may also request software configurations from a number of gaming devices in the gaming system. The server may then reconcile the software configuration on each gaming device. The software auditing server 912 may store a record of software configurations on each gaming device at particular times and a record of software download transactions that have occurred on the device. By applying each of the recorded game software download transactions since a selected time to the software configuration recorded at the selected time, a software configuration is obtained. The software auditing server may compare the software configuration derived from applying these transactions on a gaming device with a current software configuration obtained from the gaming device. After the comparison, the software-auditing server may generate a reconciliation report that confirms that the download transaction records are consistent with the current software configuration on the device. The report may also identify any inconsistencies. In another embodiment, both the gaming device and the software auditing server may store a record of the download transactions that have occurred on the gaming device and the software auditing server may reconcile these records.

In an EGM or EGD, a payout schedule for a wager is a randomized monetary Return to a Player. Some alternative industry terms for a payout schedule may include paytable, payline, payback percentage or distribution. The phrase "payout schedule" is used and defined here to avoid ambiguity that may be inherent in these alternate terms.

In the simplest terms, a payout schedule can be described as a table of information. Each of the table's entries (rows) may include at least three elements (columns). One of the elements for an entry may include some identifying information for a wagering event or multiple wagering events. Another Element of the entry may include the probability (standard mathematical definition) of the event occurring. The other important element is the payback value for the wagering event, should the wagering event occur.

The overall Return to the Player (also known as RTP) along with the payback values in the table are generally expressed as either (a) a multiple of the wager or (b) a specific value, such as a dollar (or other currency) amount. All entries in a payout schedule should be expressed in the same terms, as mixing wager multiples and specific values will typically not yield useful information.

In other implementations of a payout schedule, these listed values may not be explicitly present in the table but may instead be indirectly indicated. For instance, if two six-sided dice were used as a lookup into a payout schedule, the probability of a seven (7) being rolled is higher than any other number. If seven was indicated in the actual payout schedule, it would be indirectly related to the probability of the 7 being rolled (which is ⅙, or 0.1666666 . . . ) Those of skill in the art will recognize that there are many alternate methods of expressing a probability, as well as many alternate methods of specifying a payback value. For instance, rather than specifying the payback value in terms of dollars and cents, or as a multiple of a wager, it could be expressed instead as the value of a "Brand New Car!" or the value of a progressive prize. For clarity, this description will assume that probabilities are real numbers between 0 and 1 inclusive, while payback values will either be multiples of the wager (expressed as percentages) or constant values (such as one dollar ($1)).

Herein, the sum of all probabilities in a payout schedule will equal 1 in a complete payout schedule. It is acceptable to assume that a payout schedule has a missing entry if the sum of all probabilities is less than 1. This missing entry's probability is equal to one minus the sum of the existing Probabilities. The payback value of the missing entry is zero. If the sum of the probabilities is greater than one, the payout schedule is invalid.

To use a payout schedule, a random value must be generated. This random value must be used such that each entry in the payout schedule can be identified using some transformation of the random value combined with some form of look-up into the payout schedule using the probability of each entry. For example, consider the following payout schedule in Table 1:

TABLE 1

| Event | Probability | Payback Value |
|---|---|---|
| Die Roll = 1 or 2 or 3 | .5 | $0 |
| Die Roll = 4 | .166666 . . . | $1 |
| Die Roll = 5 | .166666 . . . | $2 |
| Die Roll = 6 | .166666 . . . | $3 |

The value of a payout schedule is a sum of products. Each entry in the payout schedule will have its own entry value. This entry value is simply the product of the probability and the payback value. The value of the payout schedule is the sum of all entry values in the payout schedule. Therefore, for the payout schedule of Table 1, its value is calculated as shown below:

$$(0.5*\$0)+(0.166666*\$1)+(0.166666*\$2)+(0.166666*\$3)=\$1.0$$

In this case, if the wager was $1, and the expected value was $1, the casino (and the player) would expect to neither win nor lose money on this game over time.

Note that random values may have different distributions. Most typical gaming devices use a uniform distribution, as a single random number is used to determine some outcome, such as a reel stop position, a wheel position, the value of a playing card, etc. However, some games or gaming devices may be configured to use a non-uniformly distributed random outcome. One such non-uniform random distribution is the Gaussian distribution. A Gaussian distribution (also known as a Normal distribution) is obtained whenever the sum of multiple uniformly distributed random numbers is calculated. For example, if the sum of two 6-sided dice is used to determine how much to pay the player, the outcome of 7 is more common than any other outcome by virtue of the Gaussian distribution of the random result of summing two 6-sided dice. The outcome is still completely random—it's just not uniformly distributed between 2 and 12. The examples used in this description will assume the generation of random numbers that are uniformly distributed unless otherwise specified. Note, however, that this does not preclude the use of non-uniform distributions in alternate embodiments.

In compliance with virtually all US-based gaming regulations, the randomized return must not be based on any previous actions or outcomes. Therefore, a gaming device is not typically permitted to alter the outcome of a random number generator because the gaming device has paid more or less than some target percentage over time. Therefore, the description and embodiments herein will assume the same constraint.

There are a large number of gambling games that are legal to play in the United States that can be reduced to one or more payout schedules. For example, the simple game of Roulette uses a uniformly-distributed random value (the ball landing somewhere on the wheel) along with a set of rules that denote the payout for each of the various possible outcomes. The payout for "black" is usually one-for-one: If you wager $1 on "black", and the ball lands on a "black" number, you will receive $1 for every $1 bet (aka 2 to 1 odds) For this wager, there are 18 black numbers, 18 red numbers, and (hypothetically) 2 green numbers (0 and 00). The frequency of getting black is 18/38, or roughly 47.4%, and has a value of 2. The frequency of getting "not-black" is roughly 52.6% and has a value of 0. Therefore, the value to the player (the payout schedule Value) for "black" wager on roulette is:

$$(2*47.4\%)+(0*52.6\%)=94.8\%$$

In other words, the casino can expect to win (after many millions of wagers) 1-0.948=0.052, or 5.2 cents, for every dollar wagered on "black" in Roulette. Note: Because no units (currency) was set on the payback values, it can be assumed that they are unit-less and, therefore, suitable to be used as a multiplier for the wager.

A classic slot machine follows a similar schedule. Each possible combination of symbols on the screen (or on a payline) has a specific Probability of occurring. That combination also has a payback value (return to player). This payback value may be zero, or it may be millions of dollars. Using the same basic formula that was used in the simple wager of "black" on Roulette, the overall payback percentage of a slot machine is determined by summing up the products of each symbol combination's probability of occurring and the payback value for that combination of symbols.

Over a sufficiently long period of time, the value of a payout schedule converges to a constant, designed value (94.8% in the previous Roulette example). For purposes of calculating the theoretical RTP of a game, regardless of the individual details comprising a payout schedule (Roulette vs. slot machine vs. other), if the values of two payout schedules (as calculated above) are the same, then the theoretical RTP for the wager will be the same. As such, the use of the term "value of the payout schedule" is inclusive of every possible way that a payout schedule can be constructed.

For instance, if an example stated: "Carrying out a predetermined action (e.g., collecting a Blue Diamond, eating a Power Pill, etc.) results in the evaluation of a payout schedule with a value of 91%", no assumption should be made about how the payout schedule is constructed. In one embodiment, the rolling of a die may be used as the value of the payout schedule. In another embodiment, a slot machine outcome may be used to determine the value of the payout schedule. In yet another embodiment, the spinning of a virtual wheel may be used to determine the value of the payout schedule. For example, a randomized lookup into a lookup-table may be used to establish the value of the payout schedule.

Even if two payout schedules have the same value, the payout schedules may have very different volatilities. In the simplest terms, a payout schedule with a higher volatility will require more wagers to converge to some given confidence interval (standard statistical definition) around the payout schedule value than a payout schedule with a lower volatility. In many (if not most) gambling games, combining the theoretical payback value with the volatility is a significant part of the craftsmanship behind mathematical game design. Unless noted otherwise, the volatility of a payout schedule does not affect the use of the term payout schedule—two payout schedules with the same value may be considered equivalent in various alternate embodiments and examples described herein.

Herein, the phrase 'wagering event' means a wager instance that is generated as a result of a player interacting with a wagering opportunity, or any wagering opportunity within a game that is recognized by the game as a wagering event. Wagering opportunities may include hardware-based actions such as: pressing a button, pulling a trigger, touching the screen, etc. Wagering opportunities may also include, but are not limited to, virtual events (events that occur virtually within a video game), such as moving a tile, touching or attempting to touch any game object with a player-controlled avatar (humanoid, vehicle, held weapon or fist, etc.) or having the player's avatar come within a certain proximity of the game object, firing a projectile at any game object (either requiring the projectile to hit or simply be fired, or alternately having the projectile aimed such that it eventually comes within a certain proximity to a game object), making a selection or a move or as the result of making a selection or a move (such as placing an "X" on a Tic-Tac-Toe board, moving your piece in a Monopoly game, sliding a tile or gem in a Match-3 game, etc.), and in general taking any action within a game or allowing any interaction to occur within a game, at any point in time or during or after any duration of time. For any of these opportunities, if a wager has been made prior to, simultaneous with or subsequent to their occurrence, and directly or indirectly because of their occurrence, the combination of the wager and the occurrence becomes known as a wagering event. There may be a myriad of possible wagering opportunities within a game. Part of the game's design will be determining which (and when) opportunities may be wagered upon, thereby defining the difference between a wagering opportunity and a wagering event. Some events may not be or include a wagering opportunity until some specific time or upon the occurrence of some other predicate event(s).

According to one embodiment, some wagering events may occur less frequently, may be associated with a greater time delay within the game, may require a greater degree of dexterity or cleverness and/or may generally be more subjectively difficult to accomplish. Some wagering events may be associated with more than one such attribute. Naturally, such wagering events may have a higher perceived value to a player than wagering events that are associated, for example, with a higher frequency of occurring and/or that require a comparatively lesser degree of dexterity, cleverness and/or that are comparatively easier to accomplish.

In any event, regardless of such attributes that may be associated with one or more wagering events, the game must be considered "fair". A primary tenet regarding fairness is that the rules of the game must be completely described to the player, such that the player may make an informed decision whether or not to play the game based on how the game is played. This rule applies to all known regulated gaming jurisdictions. The gaming embodiments shown and described herein are fair and it is assumed that the rules of the game are clearly described to the player.

Also, the game must never pay out so much money that the casino (or other gaming establishment) will consistently lose money to a player that, through luck and/or consistently skillful actions, accomplishes many or all of the wagering events. While it is acceptable, for a player that consistently accomplishes most or all wagering events that are subjectively more valuable, to win more money (including more than he or she put into the gaming machine) than another player that accomplishes none or a limited number of such subjectively more valuable wagering events, the game must be designed in such a manner as to guarantee that the winnings over time, for any player, will not cause the casino to lose money. The embodiments shown and described herein allow for the game designer to guarantee that no player, however, lucky, clever, dexterous or skillful, cannot win more than 100% of his or her wagers over a significantly long period of time and over many iterations of the game. This proposition may be called, in short-hand, the Unacceptably High Payback Rule.

Frequently within a game, there will be wagering events that may be subjectively perceived as being more valuable, harder to accomplish, that occur less frequently (collectively, Harder wagering events) and there will be wagering events that may be subjectively perceived as being comparatively less valuable, easier to accomplish, that occur more frequently (collectively, Easier wagering events). For example, in the classic Matching game Bejeweled™, matching 3 gems is considered to be Easier than matching 4 gems. Also, opportunities to match 3 gems may occur more frequently than do opportunities to match a greater number of gems (4, 5, 6, or 7, for example). In a first-person shooter game, a head shot (smaller target, more difficult to hit) may be considered to be Harder and a body shot (larger target, comparatively easier to hit) may be considered to be Easier. Because of basic human nature, players typically expect larger rewards for Harder activities.

According to one embodiment, not only may individual wagering events be Harder or Easier, but entire game (or levels within a game) may be configured to be Easier or Harder, as the player wishes. Indeed, according to one embodiment, the player may select the desired level of difficulty of the game. For example, the player may select between three different levels of difficulty; namely, Easy, Medium and Hard. Alternatively, the player may select between a lesser number of degrees of difficulty (e.g., Easy, Hard) or may select as between a greater number of levels along a spectrum of difficulty (e.g., five levels, such as Novice, Rookie, Experienced, Expert, Legend). Not all wagering opportunities need be of the player-selected difficulty level, but in the aggregate, the wagering opportunities within the game may be configured to be of the player-selected difficulty level.

Games in regulated gaming machines, as those designed for at-home console use or games found in arcades, have levels, goals or targets that the player seeks to complete, reach or hit. Such levels may include clearing a spaceship of hostile aliens, reaching a goal such as a destination or accomplishing a specific task or destroying a long-sought target. These levels, goals and targets may be configured, within the game, to be Easy, Hard, or anywhere in between, depending upon the design of the game. If configured as Easy, the zombies may be somewhat lethargic and easy to hit and kill, the task may be easy to accomplish or the target easy to destroy, or require a series of acts that are, at least in the aggregate, relatively easy to accomplish. Likewise, if configured as Hard, the zombies may be more aware and energetic and harder to hit and kill, the task may be hard to accomplish or the target hard to destroy, or require a series of acts that are, at least in the aggregate, objectively or subjectively more difficult to accomplish. According to one embodiment, the player may be presented with a plurality of difficulty levels and may be invited to select a desired difficulty level for the game or for at least the current level or session within the game. Thereafter, according to one embodiment, the game and the wagering opportunities presented within the game, may be configured according to the player-selected difficulty level.

Figure 10:
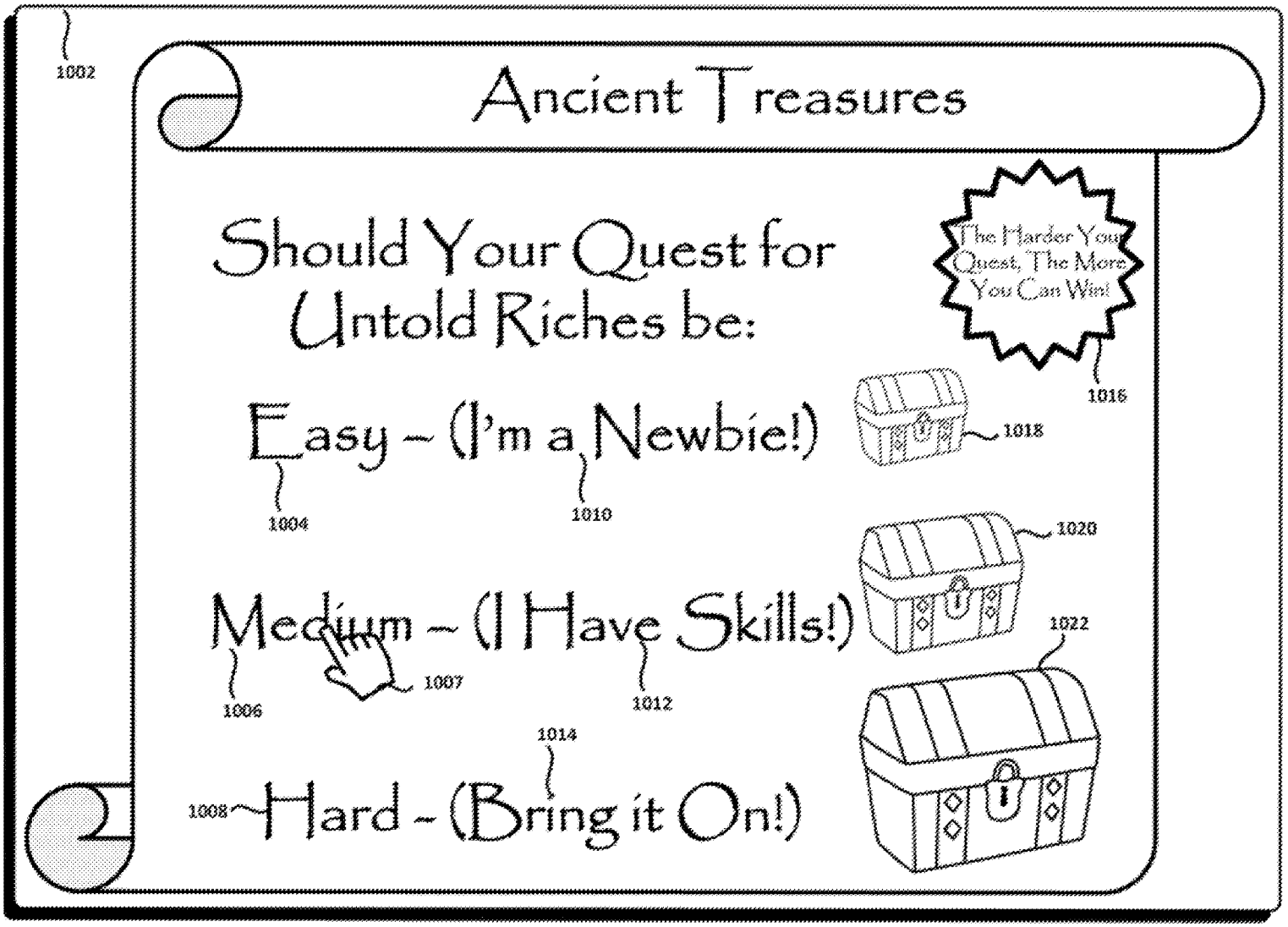
FIG. 10 is an illustrative representation of the display of a gaming machine configured according to one embodiment.

FIG. 10 is an illustrative representation of the display of a gaming machine configured according to one embodiment. As shown therein and according to one embodiment, a game 1002, called "Ancient Treasures", through a suitable user interface, invites the player to select one of a plurality of difficulty levels for the game to be played. As shown in exemplary FIG. 10, the plurality of difficulty levels includes Easy 1004, Medium 1006 and Hard 1008. Each of these difficulty levels may be selected by the player. In this exemplary implementation, each difficulty level is accompanied by a brief description and/or visual aids to help the player make the appropriate choice of difficulty levels. For the Easy difficulty level, this brief description is "I'm a Newbie!", as shown at 1010. For the Medium and Hard difficulty levels, the brief descriptions are "I Have Skills!" as shown at 1012 and "Bring it on!", as shown at 1014.

According to one embodiment, the selection of the difficulty level by a player may affect the RTP (and by extension, how much the player is likely to be rewarded on his or her wagers) of the game, level or session and may also affect game play (including, for example, how in-game assets react to received player inputs). The graphic 1016 conveys this succinctly, stating "The Harder Your Quest, The More You Can Win". The association between the player-selected difficulty level and the size of the potential reward may also be shown intuitively and graphically. For example, as shown in FIG. 10, the size of the treasure chest 1018, 1020 and 1022 is correlated with the difficulty level and RTP, with the smallest treasure chest 1018 (associated with the lowest RTP) being disposed next to the player-selectable Easy level 1004, with the next-largest treasure chest 1020 (associated with the next-highest RTP) being disposed next to the player-selectable Medium level 1006 and with the largest treasure chest 1018 (associated with the highest RTP), intended to convey the largest potential reward, being disposed next to the player-selectable Hard level 1006.

According to one embodiment, one way to implement this association between player-selectable difficulty level and potential reward is to assign a different and higher-valued payout schedule to harder levels, goals or targets than for comparatively easier levels, goals or targets. Such a paradigm allows for a consistently greater return to the skilled player as well as opportunities for the less-skilled players to hone his or her skill before attempting harder levels, goals or targets. Other embodiments are configured to enhance such a paradigm to both enhance all players' experiences and to protect the casino.

According to one embodiment, each individual wager, placed through the gaming machine receiving some player interaction when the player encounters a wagering event, should never have an expected RTP that falls below a specified minimum (such as 75% in Nevada), regardless of game state or game history. According to another embodiment, the overall RTP, over the life of the game, should not exceed some specified maximum, most likely mathematically capped at 100%, even if the player were to successfully and consistently accomplish all available skillful actions required during wagering events, irrespective of the selected difficulty level. It is to be understood that, over the short term, any player may be rewarded more than his or her wagers. However, even if the luckiest and most skilled player in the world were to play a game machine or configured according to one or more of the embodiments shown and described herein for an extended period of time, that player would never be rewarded a return that cost the casino (or other operator) money.

Figure 11:
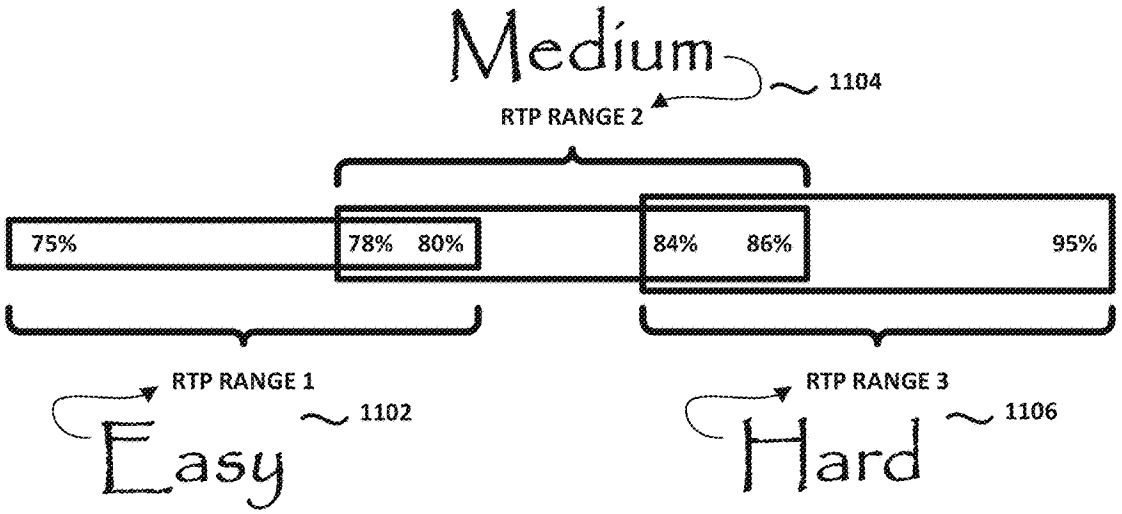
FIG. 11 is a representation of RTP ranges associated with player-selected difficulty levels, according to one embodiment.

Notwithstanding, according to one embodiment, the expected RTP of an individual wagering event within a game may be larger for a harder wagering event than the expected RTP for a comparatively easier wagering event within the same game. It is these harder (and/or less-frequently occurring) wagering events that are associated with a better (for the player) RTP, that keep the player engaged in the game at hand, and that heighten his or her excitement during game play. Engaging gameplay is usually an indicator of higher revenue in the gaming industry. According to one embodiment, an Easier (and/or frequently occurring) wagering event may have an expected RTP of (for example) 75%, while a Harder (and/or less frequently occurring) wagering event may have an expected RTP of, for example, 95%. According to one embodiment, the player-selected difficulty level determines the RTP the player can expect during game play. For example, as shown in FIG. 11, if the player selects the Easy difficulty level, the expected RTP (over many iterations of the game) may be from a regulatorily-mandated minimum (75% in the example being developed herein) to an exemplary maximum RTP of 80%. This 75% to 80% RTP range is called RTP Range 1 in FIG. 11, as shown at 1102. As also shown in FIG. 11, if the player selects the Medium difficulty level (see reference 1107 in FIG. 10), the expected RTP (over many iterations of the game) may range from, say, 78% to 86%. This 78% to 86% RTP range is called RTP Range 2 in FIG. 11, as shown at 1104. Lastly, if the player selects the Hard difficulty level, the expected RTP (over many iterations of the game) may range from, say, 84% to 95%. This 84% to 95% RTP range is called RTP Range 3 in FIG. 11, as shown at 1106. Therefore, each player-selectable difficulty level may be associated with respective maximum RTPs and/or with respective minimum RTPs (e.g., 75% for the Easy difficulty level, 78% for the Medium difficulty level and 84% for the Hard difficulty level) and respective maximum RTPs (e.g., 80% for the Easy difficulty level, 86% for the Medium difficulty level and 95% for the Hard difficulty level. Different payout schedules may be provided and stored in memory (either locally or remotely) to implement such RTP ranges, minimum RTPs and maximum RTPs.

It is to be noted that not each wagering event in a level need be of the player-selected difficulty level. Suffice it that the level, goal or target, as a whole, returns an RTP that is associated with the player-selected difficulty level. Indeed, even in a level or session configured as "Hard" following a player selection of a Hard difficulty level, there may be both easy and hard wagering events, there may be lethargic or frenetic zombies, easy to hit targets and devilishly difficult targets to destroy. According to an embodiment, however, the level, goal or target may be configured to be easier to complete, reach or hit when the player has selected an Easy difficulty level and harder to complete, reach or hit when the player has selected a comparatively-higher difficulty level, with RTPs trending from lower to higher as the selected difficulty level rises.

As shown in FIG. 11, the player may be rewarded according to (or as low as) the minimum RTP of RTP range 1 (75% in this example) if the player fails to complete the level, reach the goal or hit the target when the player-selected difficulty level is Easy. Likewise, the player may be rewarded according to (or as low as) the minimum RTP of, RTP range 2 (78% in this example) if the player fails to complete the level, reach the goal or hit the target when the player-selected difficulty level is Medium. Similarly, the player may be rewarded according to (or as low as) the minimum RTP of RTP range 3 (84% in this example) if the player fails to complete the level, reach the goal or hit the target when the player-selected difficulty level is Hard. Different player-selected difficulty levels may have different wagering requirements, minimums or other constraints to ensure that the game remains both fair to the player and profitable for the operator. As shown, the gaming machine may be configured to reward the player, on wagers made during the game, a higher amount if the player completes the level, goal or target at the selected difficulty level and a lower amount if the player fails to complete the level, goal or target at the selected difficulty level. As shown in FIG. 11, however, RTP ranges 1, 2 and 3 (shown at reference numerals 1102, 1104 and 1106) overlap one another. Indeed, the result of this overlap is that the aforementioned lower amount is lower than an amount that would have been rewarded to the player had the player selected a next-lower difficulty level than the selected difficulty level and had completed the level, goal or target at the next-lower difficulty level. Indeed, if the player selects the Medium difficulty level and is unsuccessful at completing the level, reaching the goal or hitting the target, he or she will be rewarded an amount computed at an RTP of 78%, which is lower than the amount he or she would have been rewarded had the player selected the next-lower difficulty level (Easy, in this case) and had completed the level, goal or target at the next-lower difficulty level; an amount computed at an RTP of 80%. Plainly stated, according to one embodiment, there is a penalty for choosing a high difficulty level and failing to complete the level, reach the goal or hit the target at the selected difficulty level. Other mechanisms may be provided to affect player behavior, rewards, volatility, for instance, depending upon the selected difficulty level.

Figure 12:
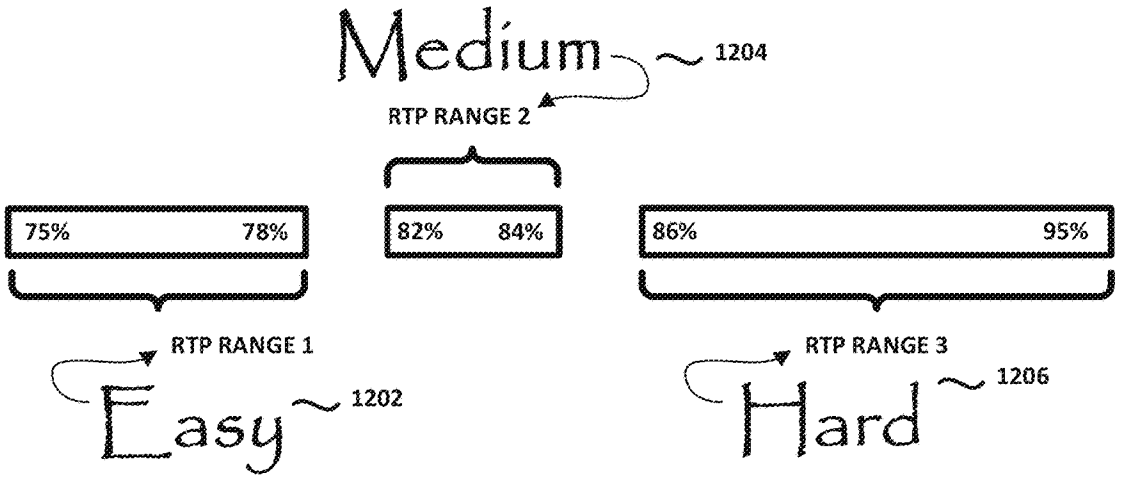
FIG. 12 is another representation of RTP ranges associated with player-selected difficulty levels, according to one embodiment.

FIG. 12 shows other possible distributions or RTPs across player-selectable difficulty levels, according to one embodiment. As shown at 1202, RTP Range 1, associated with the Easy player-selected difficulty level, ranges from a minimum RTP of 75% (likely regulatorily-mandated) to a maximum RTP of, in this example, 78%. Similarly, as shown at 1204, RTP Range 2, associated with the Medium player-selected difficulty level ranges from, for example, a minimum RTP of 82% to a maximum RTP of, for example, 84% and RTP Range 3, shown at 1206 and associated with the hard player-selected difficulty level ranges from a minimum RTP of, for example, 86% to a maximum RTP of 95%, for example. As shown from inspection of FIG. 12, RTP Ranges 1, 2 and 3 do not overlap. There may be games in which all or some of the RTP ranges overlap or there may be games in which none of the RTP ranges overlap, as shown in FIG. 12. It is up to the game designer to devise scenarios and game play that will encourage the player, via suitable RTP range incentives and disincentives, to select the desired game play difficulty and/or RTP range to maximize the player's excitement, engagement and enjoyment of the game while maintaining a predictable and reliable rate of return for the casino operator.

Figure 13:
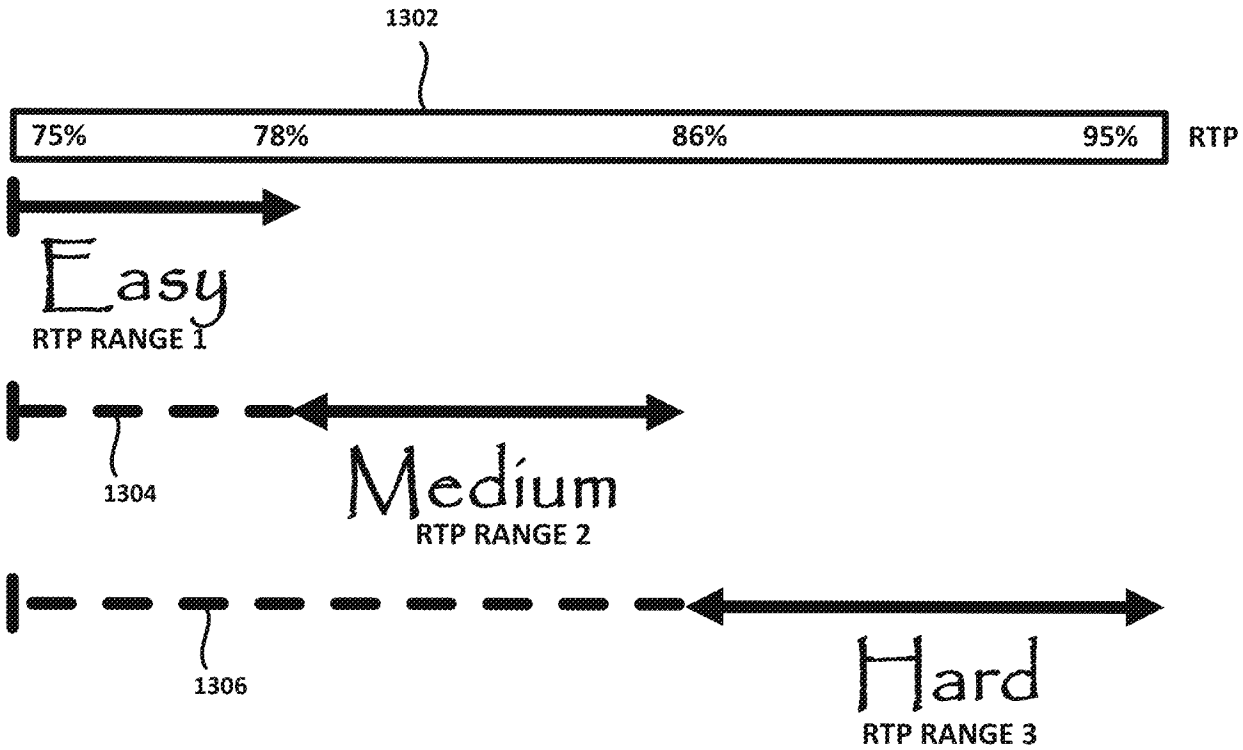
FIG. 13 is yet another representation of RTP ranges associated with player-selected difficulty levels, according to one embodiment.

For example, in FIG. 13, there is but one RTP range 1302, comprising minimum RTP of 75% and a maximum RTP of 95%. Should the player select the "Easy" difficulty level, the player can expect anywhere from 75%, on average, to about 78%, on average of the amounts wagered returned to him or her. If the player, however, selects the "Medium" difficulty level, the player can then expect RTPs of about 78% to about 86%, on average. However, as indicated by the dashed lines at 1304, should the player exhibit poor judgment, inferior skill, poor dexterity or otherwise not satisfy some other game play characteristic or metric associated with the "Medium" difficulty level, the player may then find his or her wagers being evaluated against a payout schedule or schedules that have a lower RTP than the average RTP range normally associated with the Medium difficulty level. According to one embodiment, the player may be dropped down to a lower RTP such as the regulatorily-mandated minimum RTP of, for example, 75%. Similarly, if the "Hard" difficulty level is selected by the player, the maximum RTP the player can expect, on average is 95% in this example. However, as suggested at 1306, should the player's performance fall short, on any predefined performance metric, of that expected in the self-selected Hard difficulty level, the average RTP the user can expect may be dropped to a lower level and may end up at the lowest RTP allowed of 75% in this example. According to one embodiment, the player's expected RTP may be dropped in stages. Moreover, according to one embodiment, the RTP range may also increase, from RTP range 1 to RTP range 2 or from RTP range 2 to RTP range 3, based upon predetermined game play metrics, which may be periodically evaluated during game play. The selection of the desired difficulty level may, in this manner, define the starting RTP range, which starting RTP range may be adjusted as allowed and according to any metric, game play or any desired characteristic.

According to one embodiment, the Easy player-selected difficulty level may be associated with an RTP range 1, which may be provided by the illustrative and exemplary payout schedule shown in Table 2. Therein, a random number is generated and scaled to a value between 0 and 99 (0.99). Using the "Range" column, the scaled number (0 . . . 99) is used to determine the payout amount to award the player. The "RTP (calculated)" column for each row is simply the product of the Payout and the Probability for that row. The sum of the values in this RTP column represents the overall total RTP for the entire payout schedule:

TABLE 2

| Payout | Probability | Range | RTP (calculated) |
|---|---|---|---|
| 0 | 80% | 0 . . . 79 | 0 |
| 1 | 10% | 80 . . . 89 | .10 |
| 5 | 5% | 90 . . . 94 | .20 |
| 10 | 5% | 96 . . . 99 | .45 |
| Total RTP (Sum) | | | .75 (75%) |

As shown, 80% of the time, on average, the player will lose all of his or her wager. 10% of the time, the player will be rewarded his or her even wager. 5% of the time, the player may either recover 5 or 10 times his or her wager. On average and over many different iterations, at this difficulty level, the player can expect a gaming machine so configured to return, on average, 75% of his or her wagers.

Similarly, the Medium player-selected difficulty level may be associated with an RTP range 2, which may be provided by an illustrative and exemplary payout schedule as follows:

TABLE 3

| Payout | Probability | Range | RTP (calculated) |
|---|---|---|---|
| 0 | 75% | 0 . . . 79 | 0 |
| 1 | 15% | 80 . . . 89 | .15 |
| 5 | 5% | 90 . . . 94 | .20 |
| 10 | 5% | 96-99 | .50 |
| Total RTP (Sum) | | | .85 (85%) |

Table 3 shows the payout multiplier, the probability, the range of normalized random numbers and the calculated RTP for a Medium player-selected difficulty level in which the player may be rewarded, over many iterations and over time, about 85% of his or her wagers.

Similarly, the Hard player-selected difficulty level may be associated with an RTP range 3, which may be provided by an illustrative and exemplary payout schedule such as shown in Table 4:

TABLE 4

| Payout | Probability | Range | RTP (calculated) |
|---|---|---|---|
| 0 | 80% | 0 . . . 79 | 0 |
| 2 | 10% | 80 . . . 89 | .20 |
| 5 | 5% | 90 . . . 94 | .25 |
| 10 | 5% | 96 . . . 99 | .50 |
| Total RTP (Sum): | | | .95 (95%) |

As shown, 80% of the time, on average, the player will lose his or her wager. 10% of the time, the player will be rewarded twice his or her wager. 5% of the time, the player may either recover 5 or 10 times his or her wager. On average and over many different iterations, the player having selected the Hard difficulty level can expect an average return of 95% of his or her wagers.

With reference to FIGS. 11-14, RTP range 1 may be enabled when the player selects the Easy difficulty level, and the player may be rewarded on his or her wagers using the payout schedule shown in Table 2 or some functional equivalent. Likewise, RTP range 2 may be enabled when the player selects the Medium difficulty level, and the player may be rewarded on his or her wagers using the payout schedule shown in Table 3 or some functional equivalent. Lastly, RTP range 3 may be enabled when the player selects the Hard difficulty level, and the player may be rewarded on his or her wagers made in this level using the payout schedule shown in Table 4 or some functional equivalent payout schedule.

According to some embodiments, lower RTP payout schedules may be enabled for some wagering opportunities (such as those provided in the Easy player-selectable difficulty level) while comparatively higher RTP payout schedules may be enabled for other wagering opportunities (such as those provided in the Medium and Hard player-selectable difficulty levels). In some embodiments, lower RTP payout schedules may be enabled for wagering opportunities that occur often or that the player is statistically more likely to accomplish (i.e., Easier wagering opportunities) while higher RTP payout schedules may be enabled for one or more wagering opportunities that occur comparatively less frequently and/or that the player is less likely to successfully accomplish (i.e., Harder wagering opportunities). For example, lower RTP payout schedules may be enabled for Easier wagering opportunities while higher RTP payout schedules may be enabled for Harder wagering opportunities. Easier and Harder wagering opportunities may be measured, subjectively or objectively, by the amount of game play time required to reach them, cleverness of the player, by the manual dexterity of the player, by the reaction time or speed of the player and/or by any other metric that results in a statistical differential between the rate of unsuccessfully completing a predetermined action or actions upon encountering a predetermined wagering opportunity and the rate of successfully completing the action or actions upon encountering the same predetermined wagering opportunity during game play. Indeed, the player may accept a lower rate of return for accomplishing tasks he or she (and/or the game designer) perceives as Easier in exchange for a comparatively higher rate of return for accomplishing tasks he or she (and/or the game designer) perceives as being Harder, wagering opportunities that conclude a chapter of the game's narrative or that are thematically significant to the game.

According to embodiments, the wagering opportunities within a player-selected difficulty level, according to one embodiment, may be of the same or different difficulty, however that term is defined by the game designer. Indeed, all wagering opportunities in the Easy player-selected difficulty level may be "Easy" or there may be a mix of "Easy", "Medium" and "Hard" wagering opportunities to present varied and challenging wagering opportunities to the player or to build or release tension during game play. However, the mix of "Easy", "Medium" and "Hard" wagering opportunities may trend toward the "Easy" end of the difficulty spectrum in the Easy player-selectable difficulty level. Similarly, the mix of "Easy", "Medium" and "Hard" wagering opportunities (if there is such a mix) may trend toward "Medium" in the difficulty spectrum in the Medium player-selectable difficulty level and toward the "Hard" end of the difficulty spectrum in the Hard player-selectable difficulty level. Alternatively, all the perceived difficulty level of all wagering opportunities in each player-selected difficulty level may be holly homogeneous within level: all wagering opportunities in the player-selected Easy level may be "Easy", all wagering opportunities in the player-selected Medium level may be of "Medium" difficulty and all wagering opportunities in the player-selected Hard level may be "Hard".

Figure 14:
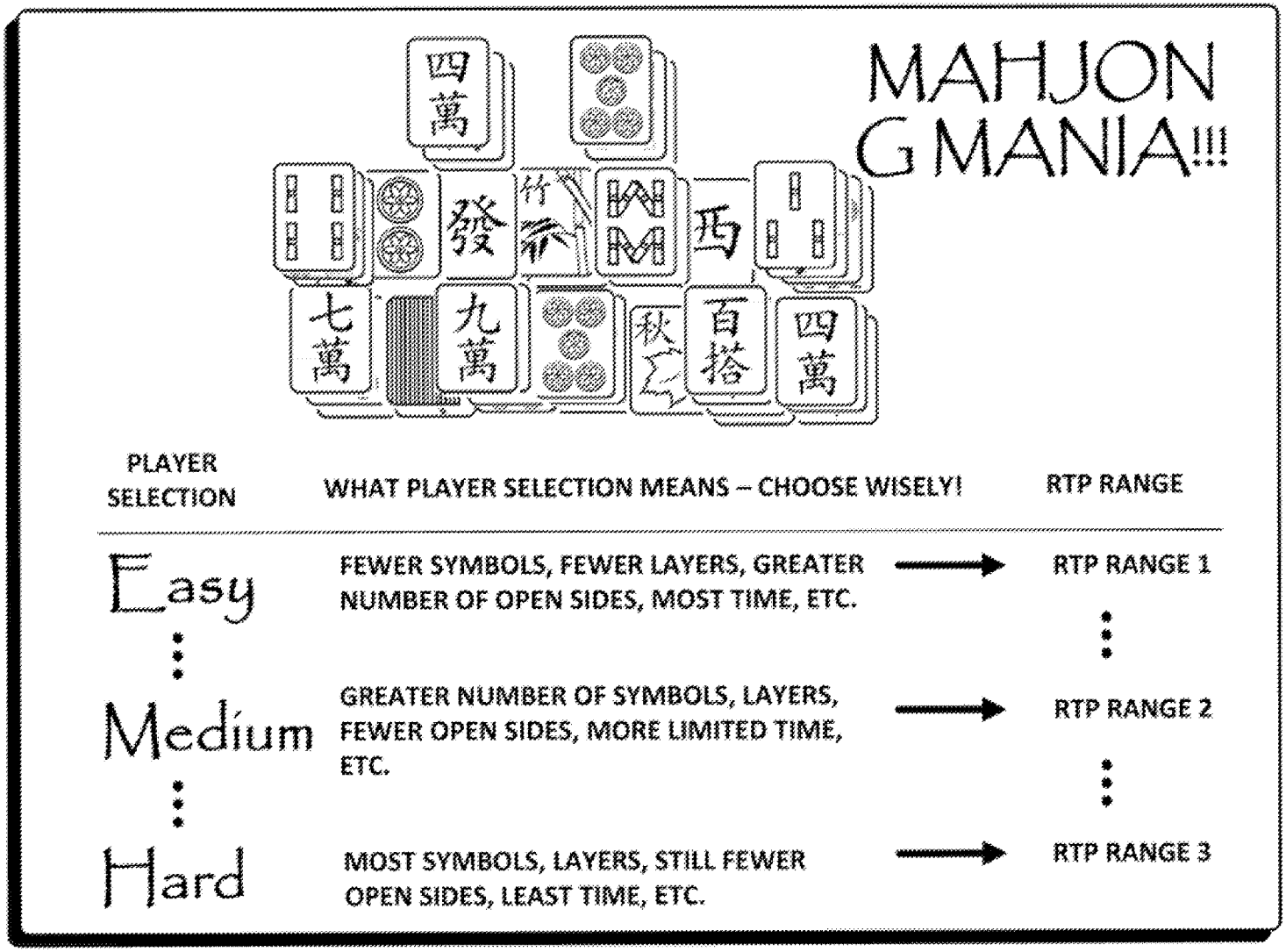
FIG. 14 is an illustrative representation of the display of a gaming machine showing a Mahjong game configured for wagering, according to one embodiment.

To further illustrate the use of lower RTPs for Easier wagering opportunities and higher RTPs for comparatively Harder wagering opportunities, the following paragraphs discuss a matching game. As shown in FIG. 14, the following presents exemplary features of a Mahjong game, modified for wagering according to one embodiment. It is to be understood, however, that most (if not all) of the game parameters and characteristics may be altered to offer an entertaining experience for the player. As such, the numbers and values used below are arbitrarily chosen for purposes of clarity of explanation and should not be interpreted as limiting any embodiment described herein. Mahjong is an ancient Chinese game that is played with a set of 144 tiles based on Chinese characters and/or symbols, although there are many variants of the game. The object of the game is to remove pairs of matching tiles until the last paid of tiles is removed. There are additional constraints, in that a tile must have at least one free side to be removable. A free side may be defined as a right, left, top or bottom side that does not have a next-adjacent neighbor on its level. Other games may be adapted and presented according to embodiments. For example, each or selected acts of removing tiles may give rise to a wager.

Herein, it is believed that a player is willing to accept a lower reward for accomplishing Easy tasks than for accomplishing Hard tasks. Accordingly, as shown in FIG. 14, the Mahjong player is invited to select a desired difficulty level. In FIG. 14, these difficulty levels are again Easy, Medium and Hard, although other difficulty levels may be offered. What "difficulty" means, within the context of this disclosure, will vary from game to game, depending upon the choices made by the game designer to influence game play, shape player behavior and influence wager outcomes. In the illustrative example shown in FIG. 14, the Easy difficulty level means fewer symbols, fewer layers of tiles, a greater number of open slides and may also mean that the player has the most time to make his or her matches, at least as compared to the Medium and Hard difficulty levels. Should the player select the Medium difficulty level, he or she can expect a greater number of symbols, layers, fewer open sides and may be given a more limited period of time in which to make his or her matches, at least as compared to the Easy level. Similarly, should the player select the Hard difficulty level, he or she can expect the most symbols, layers, still fewer open sides and/or the least amount of time to make his or her matches. According to one embodiment, each of the difficulty levels may be associated with respectively different RTPs or RTP ranges. As discussed elsewhere, should the player fail to perform at the selected difficulty level, his or her expected RTP may be dropped down to a lower RTP or RTP range.

Figure 15:
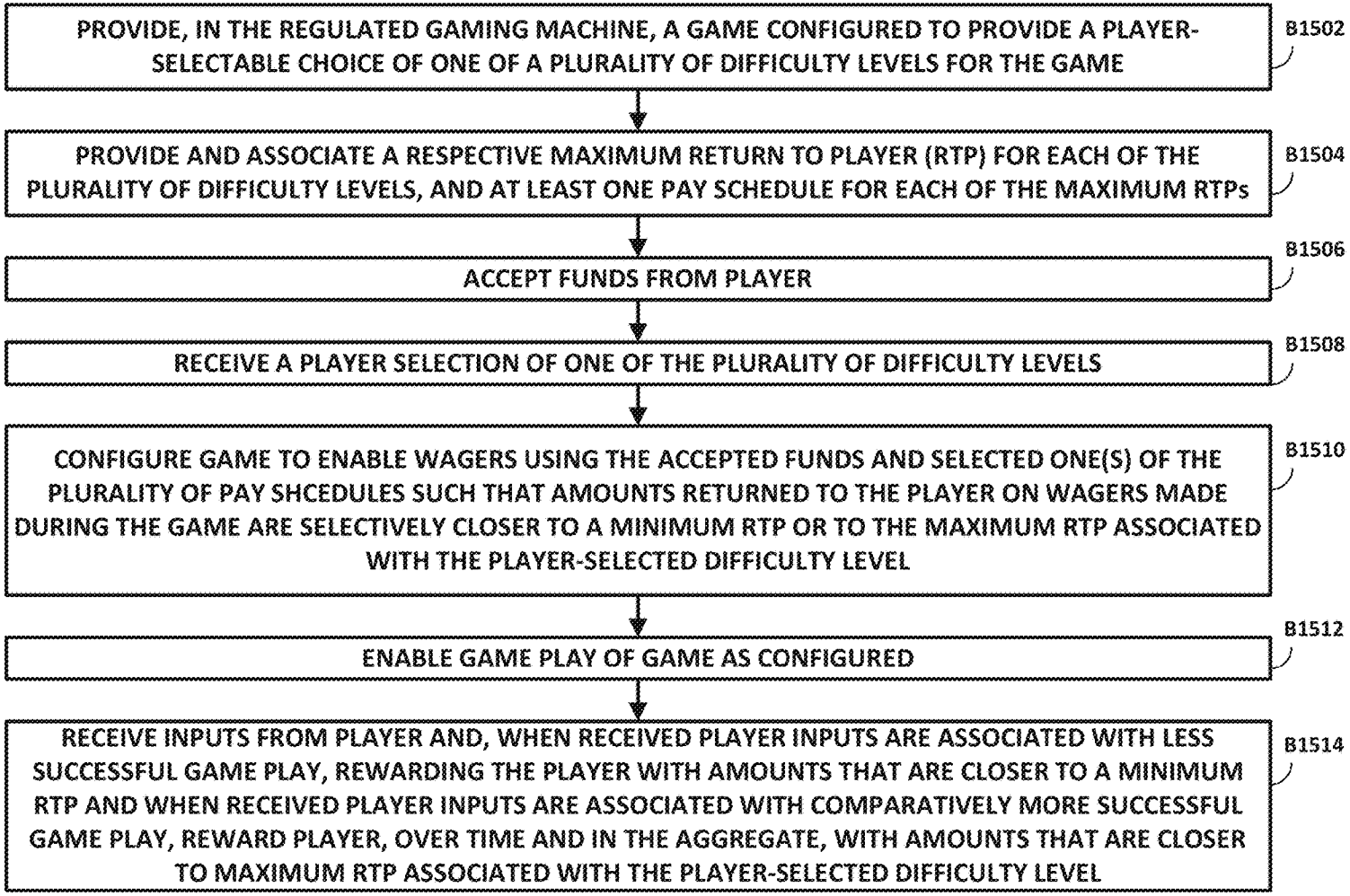
FIG. 15 is a flowchart of a method according to one embodiment.

FIG. 15 is a flowchart of a method according to one embodiment. In particular, FIG. 15 is a flowchart of a method of determining rewards due to a player playing a regulated gaming machine (e.g., an EGM or an EGD, as described above). In one embodiment, the method may comprise, as shown at B1502, providing, in the regulated gaming machine, a game configured to provide a player-selectable choice of one of a plurality of difficulty levels for the game. Block B1504 calls for providing and associating a respective maximum RTP with each of the plurality of difficulty levels and for providing one or more payout schedules for each of the maximum RTPs. After accepting funds from the player, the game may prompt the player to select, via a suitable interface (such as a touchscreen, for example), a preferred one of a plurality of difficulty levels and the gaming machine may receive, as shown at B1508, the player's selection of one of the presented difficulty levels.

As called for by B1510, the game may be configured to enable wagers using the accepted funds and a selected one or ones of the payout schedules, such that amounts returned to the player on wagers made during the game are selectively closer to a minimum RTP or to the maximum RTP (e.g., between the minimum RTP and the maximum RTP) associated with the player-selected difficulty level. With the game so configured, game play may then be enabled, as shown at B1512. As shown at B1514, the regulated gaming may receive inputs from the player and, when the received player inputs are associated with (or otherwise result in) less successful game play, the gaming machine may reward the player with amounts that are closer to a minimum RTP and when the received player inputs are associated with (or otherwise result in) comparatively more successful game play, the gaming machine may reward the player, over time and in the aggregate, with amounts that are closer to the maximum RTP that is associated with the player-selected difficulty level.

According to one embodiment, the provided and associated respective maximum RTP is greater for a lower difficulty level than it is for a comparatively higher difficulty level. In one embodiment, the game may be configured with at least one level, goal or target that may be configured such that player inputs that are operative to complete the level, goal or target are more likely to be received when a selection of a lower difficulty level is received than when a selection of a comparatively higher difficulty level is received. According to one embodiment, rewarding may comprise rewarding amounts consistent with the maximum RTP associated with the player-selected difficulty level only when the player completes the level, goal or target. Rewarding may comprise rewarding the player, on wagers made during the game, a higher amount if the player completes the level, goal or target at the selected difficulty level and a lower amount if the player fails to complete the level, goal or target at the selected difficulty level. The lower amount, according to one embodiment, may be lower than an amount that would have been rewarded to the player had the gaming machine received a player selection of a next-lower difficulty level than the selected difficulty level and had received player inputs consistent with completing the level, goal or target at the next-lower difficulty level.

Rewarding may comprise rewarding the player, on wagers made during the game a first amount when a first difficulty level of the plurality of difficulty levels is selected and when player inputs are received that are consistent with failing to complete a level, goal or target at the first difficulty level. Similarly, rewarding may comprise rewarding the player a second amount when a second difficulty level of the plurality of difficulty levels is selected and when player inputs are received that are consistent with failing to complete a level, goal or target at the second difficulty level. According to one embodiment, the second difficulty level may be higher than the first difficulty level and the first amount may be lower than the second amount. This may encourage players to select a difficulty level that is consistent with their perceived ability to complete the level, goal or target. According to one embodiment, the game may be further configured to suggest an appropriate difficulty level. Such gaming machine-generated suggestion may be based upon, for example, stored and accessed data of the player's past performance at this or similar games. The game, according to one embodiment, may be an arcade-style game and/or a scripted game, for example.

Figure 16:
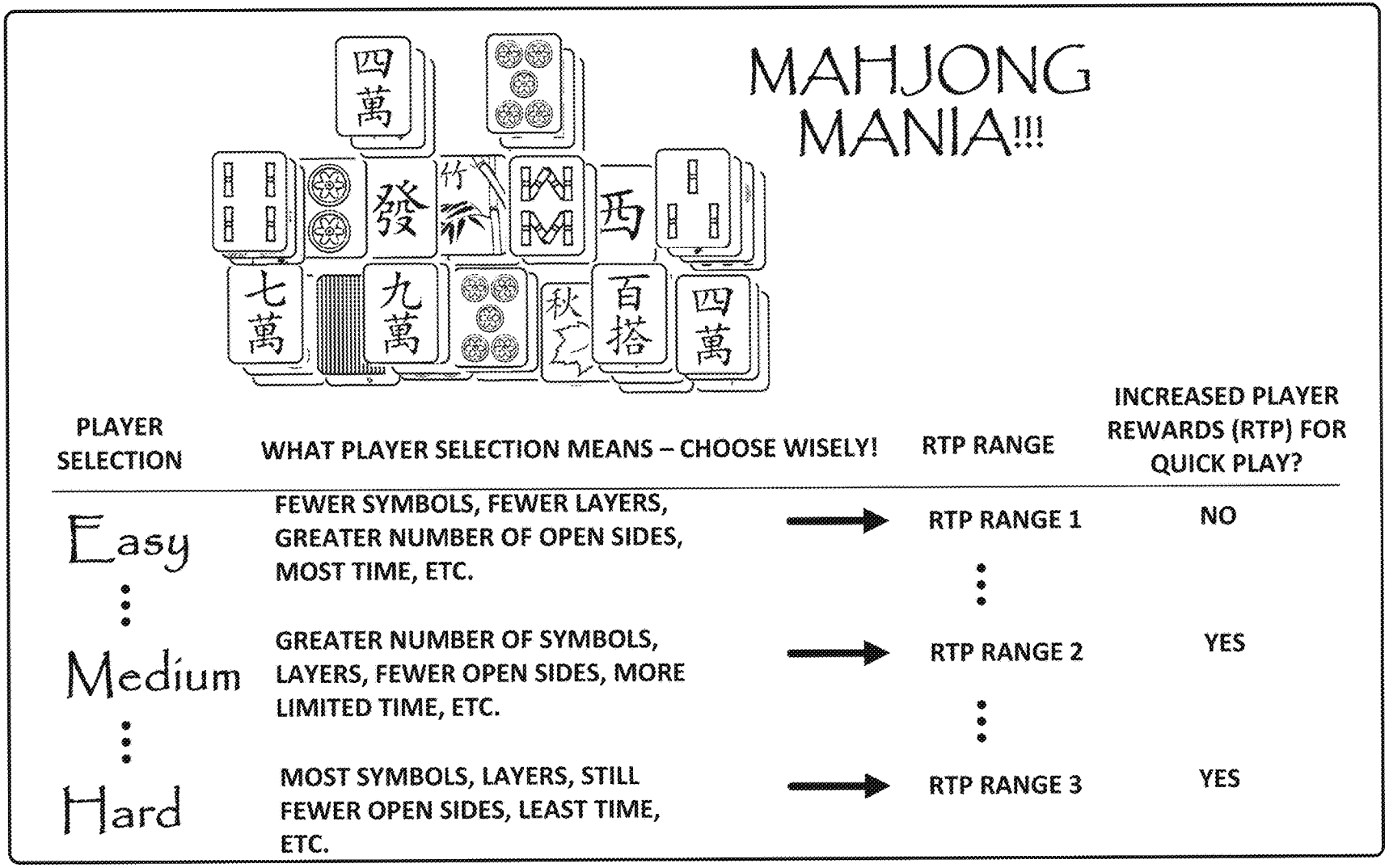
FIG. 16 is an illustrative representation of the display of a gaming machine showing a Mahjong game configured for wagering, according to another embodiment.

FIG. 16 is an illustrative representation of the display of a gaming machine showing a Mahjong game configured for wagering, according to another embodiment. FIG. 16 is similar to FIG. 14, but for added functionality of increased rewards for quick game play. Indeed, according to one embodiment, the player's interactions with the Mahjong tiles may be timed, and the player rewarded for playing quickly; that is for rapidly removing pairs of matching tiles until the last paid of tiles is removed. Each game may be timed, or each move may be timed. Indeed, the time(s) elapsed until successful interaction (time to find and remove a matching pair, for example) may be used to select one of a plurality of payout schedules, with each of the plurality of payout schedules being associated with a different RTP percentage. In this manner, shorter times elapsed until successful interaction may, according to one embodiment, cause a selection of payout schedules that are more advantageous to the player than comparatively longer times elapsed until successful interaction. In the implementation of FIG. 16, such enhanced payout schedules are not available for the Easy play mode—although they could be. In FIG. 16, the Medium and Hard play modes are provided with payout schedules that are or become more advantageous to the player when the player plays fast and with payout schedules that are or become comparatively less advantageous when game play is slower. As shown in FIG. 16, player selection of the level of difficulty (higher RTPs for harder play modes) may be combined with still more advantageous payout schedules (or further enhanced payout schedules) that are accessed when the player quickly successfully interacts with the in-game assets (the tiles, in this case). Therefore, according to one embodiment, the best RTPs may be achieved when the player selects the hardest difficult level and plays fast. There may some overlap in the RTPs between, say, the Medium difficulty level played fast, and the Hard difficulty level played slowly, or the RTPs may increase monotonically as the difficulty level and speed of game play increases, with no overlap.

Figure 17:
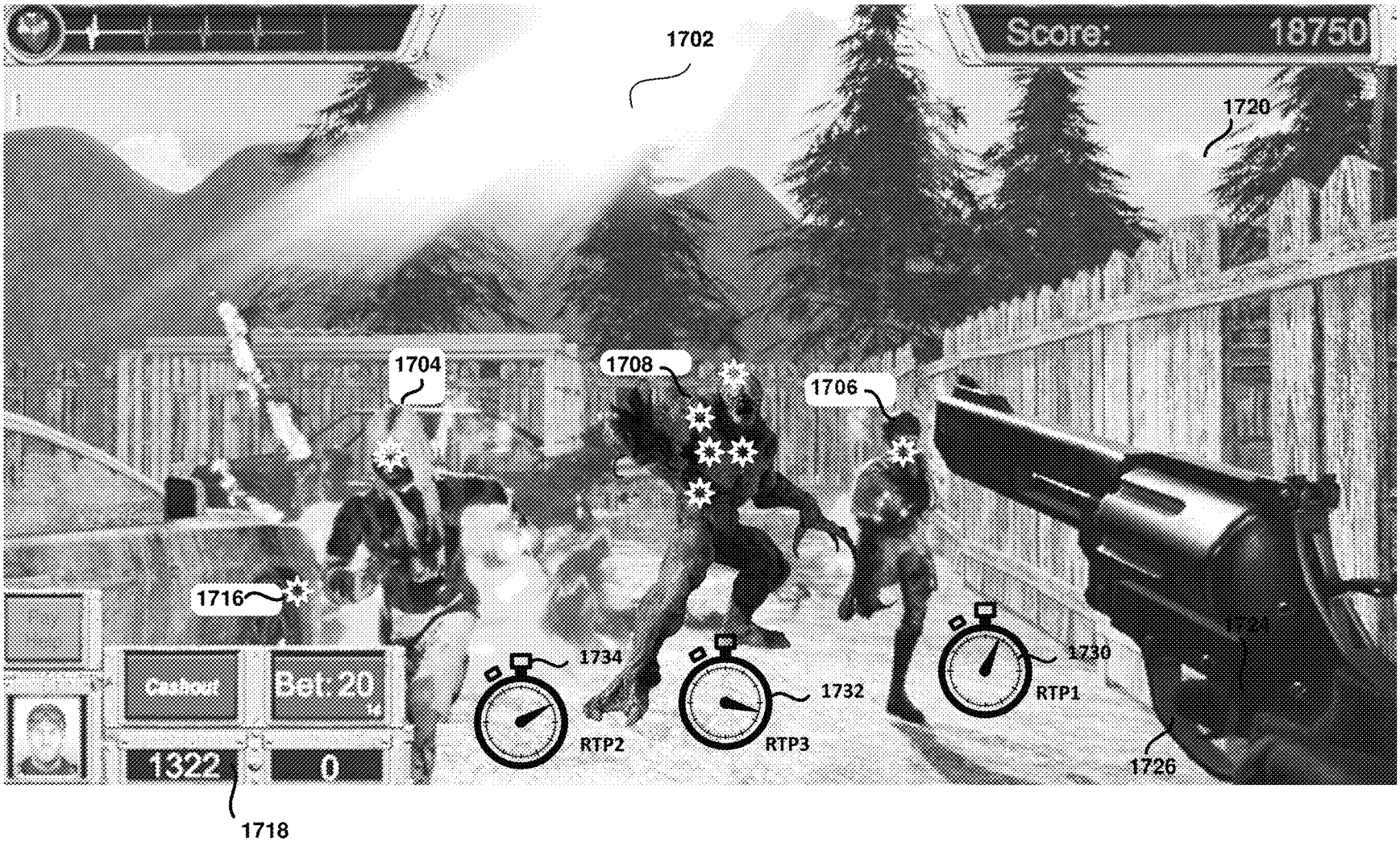
FIG. 17 is a scene of a first-person shooter type game of a regulated gaming machine according to one embodiment, showing the effect of times to successful interaction on the RTPs of wagering events.

FIG. 17 is a scene of a first-person shooter type game of a regulated gaming machine according to one embodiment, showing the effect of times to successful interaction on the RTPs of wagering events. This game comprises a plurality of in-game assets, at least some or each of which being configured to generate a wagering opportunity when interacted with by the player. Here, the in-game assets are zombies 1704, 1706 and monsters, such as boss zombie 1708. The object of the game is to shoot zombies 1704, 1706 and the boss zombie 1708 using a weapon 1726 controlled via player interactions with the regulated gaming machine's user interface. During game play, the regulated gaming machine receives skilled player interactions, via the user interface, with one or more of the zombie in-game assets. Interacting with an in-game asset such as a zombie 1704 or 1706 generates a wagering opportunity. For each generated wagering opportunity, the regulated gaming machine may then determine whether the received player interaction(s) resulted in a successful or an unsuccessful interaction with the in-game asset with which the player interacted. In terms of the zombie first person shooter game of FIG. 17, a successful interaction means (re)killing the zombie and an unsuccessful interaction is one in which the marauding undead is merely injured or an interaction in which the player's shot missed the zombie entirely, as shown at 1716.

According to one embodiment, the speed at with which the player dispatches the zombies back to their graves or unceremoniously on the side of the road may affect the payout schedule with which the regulated gaming device determines player rewards. That is, at least for each successful interaction, the regulated gaming machine may not only generate a wagering event but may also determine a time elapsed until successful interaction. Thereafter, for at least some of the generated wagering events (some may not be susceptible to enhanced RTPs for fast play), the determined time elapsed until successful interaction may be used alone or in conjunction with other factors, to select one of a plurality of payout schedules, each of which being associated with a different RTP percentage. Thereafter, an award of player game credits to the player may be generated according to the selected payout schedule and the RTP associated with the selected payout schedule. According to one embodiment, shorter times elapsed until successful interaction cause a selection of payout schedules that are more advantageous to the player than comparatively longer times elapsed until successful interaction.

Herein, the phrase "time to successful player interaction" is intended to encompass any measurement(s) of time that attempts to quantify how fast the player was in achieving the game's objective or sub-objectives. For example, the time it takes the player to kill a zombie is a time to successful interaction. Referring back to FIG. 17, the time to successful interaction is suggested by the stylized stopwatches at 1730, 1732 and 1734. These stopwatches would likely not be displayed on-screen; they are shown in FIG. 17 solely to graphically show the times to successful interactions with zombies 1704, 1706 and with boss zombie 1708, for purposes of explanation. As shown in FIG. 17, stopwatch 1730 shows the shortest elapsed time to successful interaction. Here the stopwatch would be stopped upon the player's successful interaction with zombie in-game asset 1706. The successful interaction in question here is the killing of zombie 1706 by a head shot. The player also engaged zombie in-game asset 1704, but missed, as shown at 1716, which would be considered to be an unsuccessful player interaction with zombie 1704. The player apparently then adjusted his or her aim, took another shot and successfully interacted with zombie 1704, dropping it via a well-aimed head shot. The time to successful interaction, in this case, was somewhat longer than the time to successful interaction with zombie 1706, as suggested by stopwatch 1734, which stopped when the kill head shot landed. Lastly, the time to successful interaction with boss zombie 1708 is longer than it was with either zombies 1706 or 1704. This may not be because the player is a poor shot, but because a boss zombie, in this example, can survive up to four body shots. When the boss zombie was also shot in the head, it died, stopping stopwatch 1732 and establishing the time to successful interaction with the boss zombie.

Thereafter, according to one embodiment, for each in-game asset with which the player successfully interacted, one or more determined times elapsed until successful interaction may be used (alone or in conjunction with other factors) to select one of a plurality of payout schedules, each of which may be associated with a different RTP percentage. For each such in-game asset with which the player successfully interacted, an award of player game credits to the player may be generated according to the selected payout schedule and the RTP associated with the selected payout schedule. In this manner, shorter times elapsed until successful interaction (faster killing of zombies in this example) cause a selection of payout schedules that are more advantageous (return greater rewards) to the player than comparatively longer times elapsed until successful interaction. For example, the wagering event generated as a result of killing zombie 1706 may determine the reward due to the player using a payout schedule having an RTP percentage of 95%. Similarly, the wagering event generated as a result of killing zombie 1704 may determine the reward due to the player using a payout schedule having an RTP percentage of 85%, as the time to successful interaction was longer for killing zombie 1704 than it was for killing zombie 1706. The wagering event generated as a result of killing the boss zombie 1708 may determine the reward due to the player using a payout schedule having an RTP percentage of say 90%, if the player was reasonably efficiently in killing the boss zombie. Indeed, even though killing the boss zombie took the longest, the degree of difficulty was high which, in itself, may have caused rewards to be generated using a different set of payout schedule in which the degree of difficulty is considered. Together, the degree of difficulty and the speed at which the successful interaction took place may together determine the payout schedule and RTP used to determine player rewards. The degree of difficulty and the speed of the successful interaction may each contribute equally to the determination of which payout schedule to use to determine player rewards, or either one may be weighted more than the other, as the game designer chooses.

Figure 18:
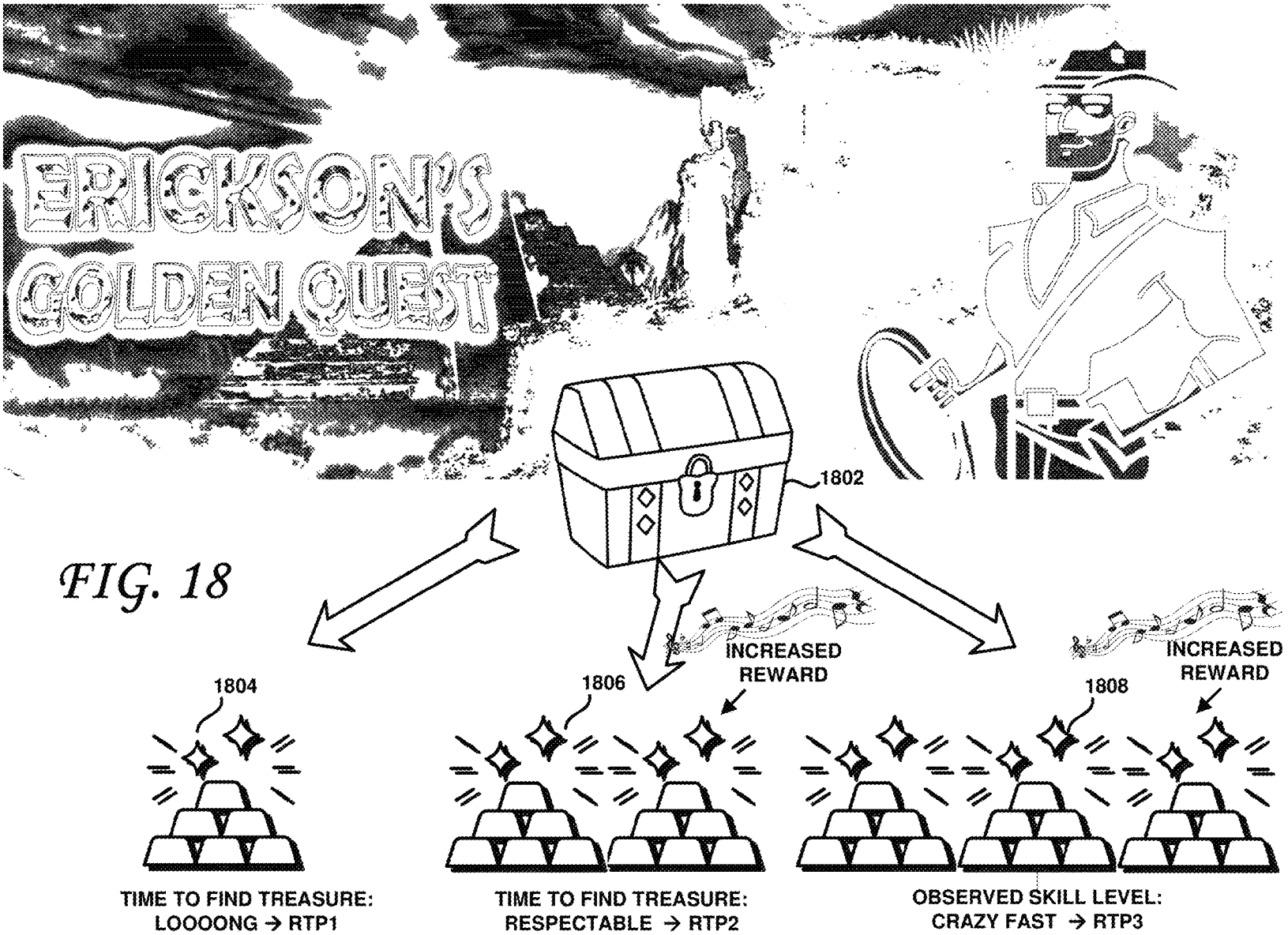
FIG. 18 is a scene of an adventure type game of a regulated gaming machine, showing the effect of times to successful interaction on the RTPs of wagering events, according to one embodiment.

FIG. 18 is a scene of an adventure type game of a regulated gaming machine, showing the effect of times to successful interaction on the RTPs of wagering events, according to one embodiment. Indeed, FIG. 18 is a scene of an adventure type game of a regulated gaming machine, showing the effect of times to successful interaction on the RTPs of wagering events, according to one embodiment. Erickson's Golden Quest is an example of an adventure game in which, for our purposes here, the titular Erickson seeks a treasure chest 1802. To do so, the titular character must carry out many acts, requiring many interactions with in-game assets during his treasure quest. In one embodiment, the time elapsed until successful interaction may be determined in the aggregate for many successful interactions with many in-game assets. The determination of the aggregate time to successful interaction, in this embodiment, may be used to select one of a plurality of payout schedules, each of the plurality of payout schedules being associated with a different return to player RTP percentage. As shown, a player that has taken a long time to complete all required acts to achieve the game's objective may be rewarded using a payout schedule associated with RTP1, as suggested at 1804, which may be a payout schedule associated with an RTP closer to the minimum RTP than the maximum RTP, such as, for example, 75%. As shown at 1806, a player that has taken a respectably short period of time to complete all required acts to achieve the game's objective (i.e., finding the treasure in this case) may be rewarded using a payout schedule associated with RTP2, which may be a payout schedule associated with an RTP somewhere close to midway between the minimum and maximum RTPs such as, for example, 85%. Lastly, a player that has completed all required acts very quickly may be rewarded using a payout schedule associated with RTP3, which may be a payout schedule associated with an RTP close to the maximum RTP such as, for example, 95%. As discussed above, the player's demonstrated skill may also be taken into account in selecting the payout schedule to use in rewarding the player. It is to be noted that, instead of a plurality of payout schedules, a single payout schedule, a lesser or a greater number of payout schedules may be used, together with speed and/or skill coefficients, weighting factors or other mathematical and/or logical operators that may operate to either increase or decrease the RTP between minimum and maximum values. Hence, the phrase "plurality of payout schedules" explicitly includes, within its scope the case in which a single payout schedule is used but is modified using mathematical and/or logical operators to vary the RTP between minimum and maximum percentage values.

Figure 19:
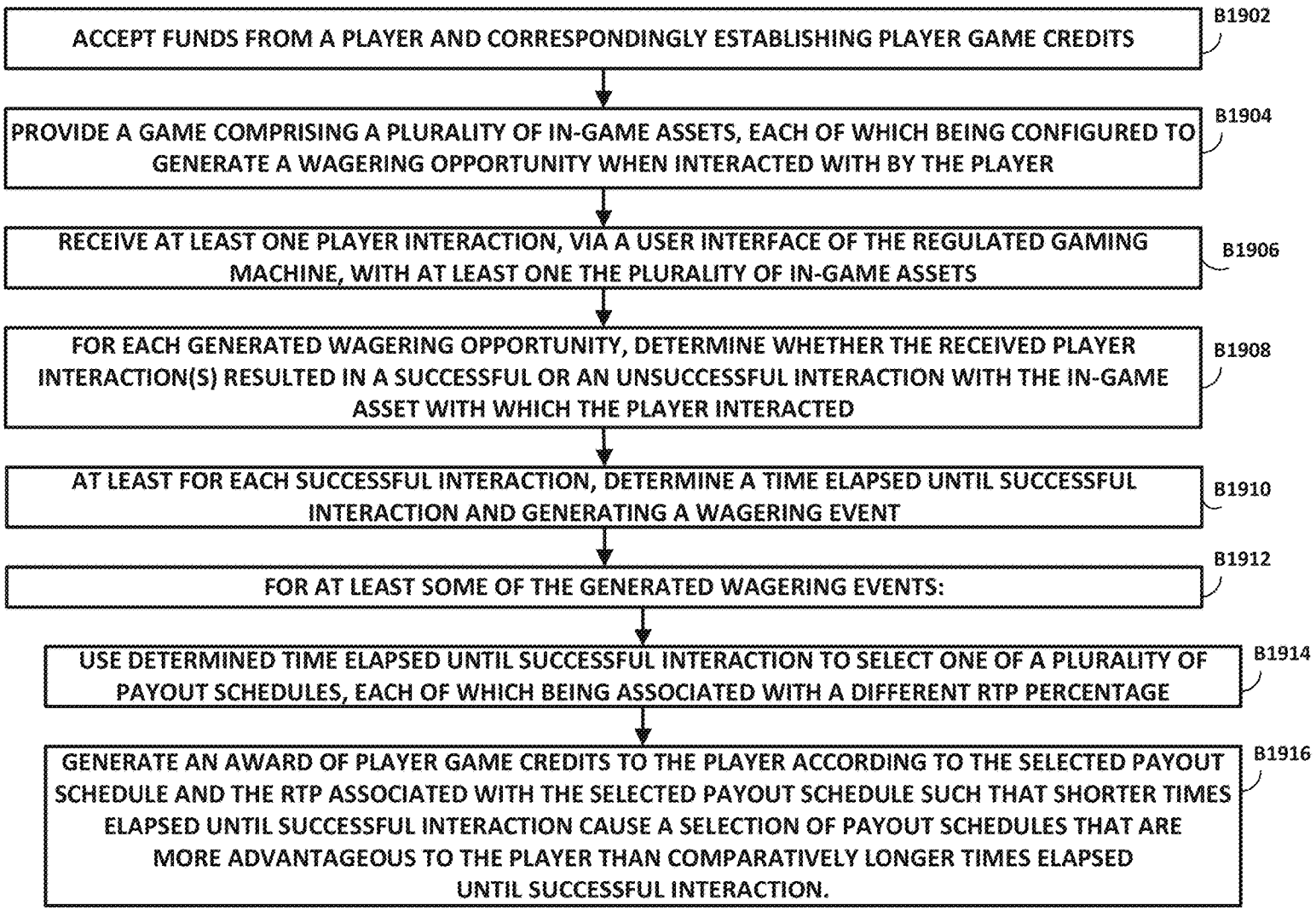
FIG. 19 is a flowchart of a computer-implemented method according to one embodiment.

FIG. 19 is a flowchart of a computer-implemented method according to one embodiment. As shown at B1902, the computer-implemented method may comprise accepting funds, in the regulated gaming machine, from a player and correspondingly establishing player game credits. At block B1904, a game may be provided in in the regulated gaming machine, comprising a plurality of in-game assets, each of the plurality of in-game assets being configured to generate a wagering opportunity when interacted with by the player. At least one player interaction may be received at B1906, via a user interface of the regulated gaming machine, with at least one the plurality of in-game assets. As shown at B1908, for each generated wagering opportunity, it may be determined whether the received player interaction(s) resulted in a successful or an unsuccessful interaction with the in-game asset with which the player interacted. At least for each successful interaction, block B1910 calls for determining a time elapsed until successful interaction and generating a wagering even. As shown at B1912, for at least some of the generated wagering events, the determined time elapsed until successful interaction may be used as shown at B1914 to select one of a plurality of payout schedules, each of the plurality of payout schedules being associated with a different return to player (RTP) percentage. As called for at B1916, an award of player game credits to the player may be generated according to the selected payout schedule and the RTP associated with the selected payout schedule, such that shorter times elapsed until successful interaction cause a selection of payout schedules that are more advantageous (i.e., return more money or other monetary or non-monetary value) to the player than comparatively longer times elapsed until successful interaction.

According to further embodiments, at least some of the plurality of payout schedules may be associated with respectively different ranges of times elapsed until successful interaction. In one embodiment, the plurality of payout schedules may comprise a first payout schedule and a first associated RTP that is configured to be selected when the time elapsed until successful interaction is within a first range of times elapsed until successful interaction; a second payout schedule and a second associated RTP that is configured to be selected when the time elapsed until successful interaction is within a second range of times elapsed until successful interaction; and a third payout schedule and a third associated RTP that is configured to be selected when the time elapsed until successful interaction is within a third range of times elapsed until successful interaction. The first, second and third ranges may be different from one another, may overlap or may not overlap and may define, for example, a slowest range, a next fastest range and a fastest range of times until successful interaction. Other orderings are possible. In one embodiment, at least two times elapsed until successful interaction may be used to select one of a plurality of payout schedules. A lesser or a greater number of payout schedules and associated RTPs may be implemented, as those of skill in this art may recognize. One embodiment includes grouping different kinds of in-game assets in different classes and establishing different classes of payout schedules and associated RTPs for wagering events generated upon successful interactions with the different classes of in-game assets. In one embodiment, for each successful interaction with an in-game asset, the determination of the time elapsed until successful interaction may comprise measuring the time elapsed between the time at which the in-game asset becomes available for player interaction and the last player interaction with the in-game asset that resulted in the successful interaction. In one embodiment, for each successful interaction with an in-game asset, the determination of the time elapsed until successful interaction may comprise measuring the time elapsed between the first and the last player interaction with in-game asset that results in the successful interaction. Other methods of measuring the time elapsed until successful interaction may be implemented, as such may be game-specific.

Figure 20:
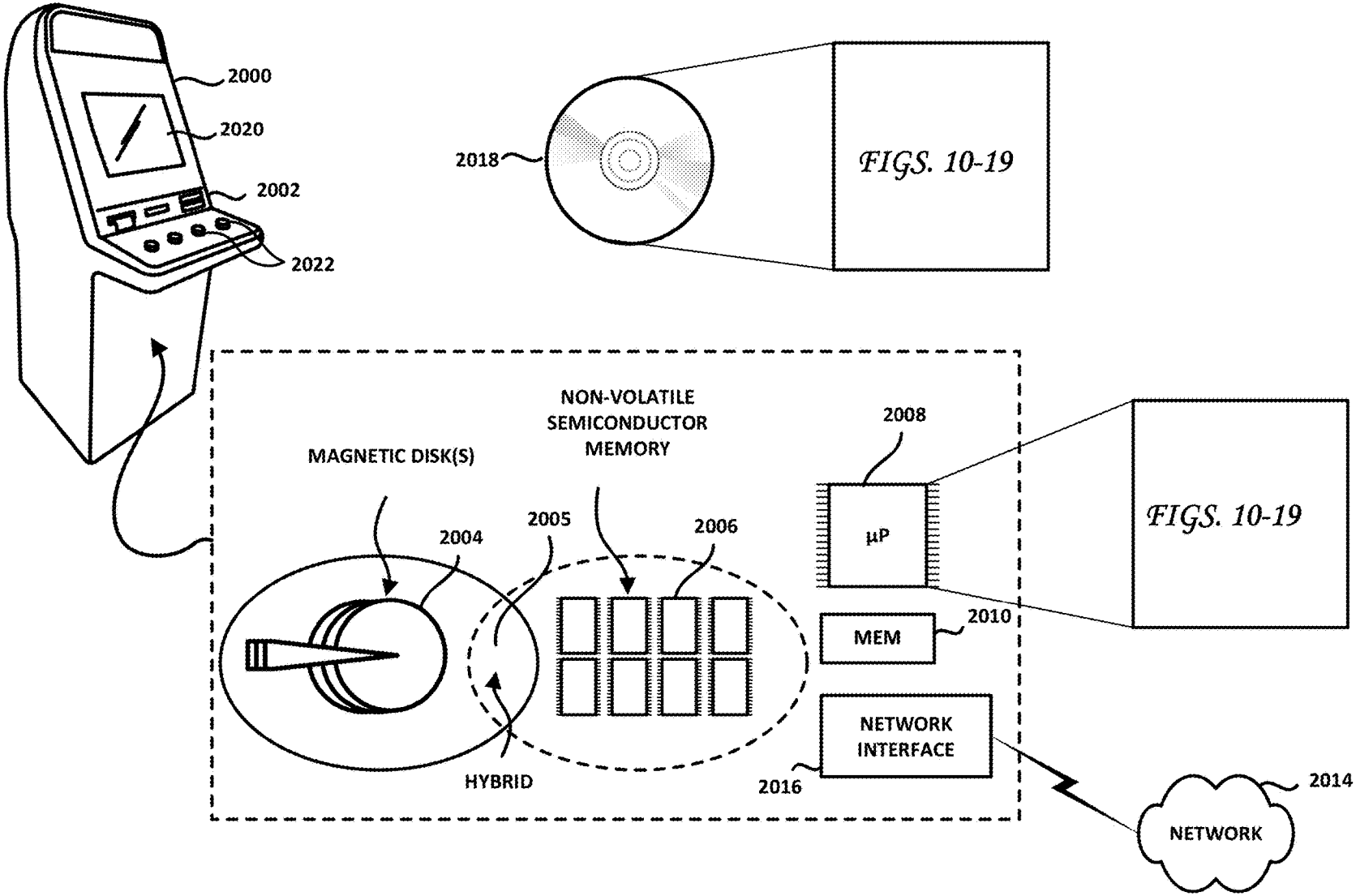
FIG. 20 shows a wager-based regulated gaming machine configured according to embodiments.

FIG. 20 shows a wager-based regulated gaming machine configured according to embodiments. According to one embodiment, an electronic, wager-based gaming device 2000 may comprise a memory or memories 2004, 2005, 2006, 2010, at least one processor 2008, a display 2020 and a user interface 2022. A plurality of processes may be spawned by the processor, which plurality of processes may comprise processing logic to carry out the functionality shown and described relative to FIGS. 10-19. FIG. 20 also shows exemplary tangible, non-transitory computer-readable media 2018, 2004, 2005 or 2006 having data stored thereon representing sequences of instructions which, when executed by the regulated gaming computing device, cause the regulated gaming computing device to determine rewards due to a player playing a wager-based game according to embodiments.

Discussing now FIG. 20 in greater detail, reference number 2000 is a regulated gaming machine, also referenced herein as an electronic gaming device (EGD) and electronic gaming machine (EGM). The regulated gaming machine 2000 may comprise direct access data storage devices such as magnetic disks 2004, non-volatile semiconductor memories (EEPROM, Flash, etc.) 2006, a hybrid data storage device 2005 comprising both magnetic disks 2004 and non-volatile semiconductor memories, one or more microprocessors 2008 and volatile memory 2010. The regulated gaming machine 2000 may also comprise a network interface 2016, configured to communicate over network 2014 with remote servers, storage services and the like. References 2004, 2005 and 2006 are examples of tangible, non-transitory computer-readable media having data stored thereon representing sequences of instructions which, when executed by a regulated gaming computing device, cause the regulated gaming computing device to provide wager-based games and determine rewards due to a player playing such wager-based game as described and shown herein, particularly at FIGS. 10-19. Some of these instructions may be stored locally in the gaming machine 2000, while others of these instructions may be stored (and/or executed) remotely and communicated to the gaming machine 2000 over the network 2014. In other embodiments, all these instructions may be stored locally in the gaming machine 1302, while in still other embodiments, all of these instructions are stored and executed remotely, based on payer interactions at the gaming machine 2000, and the results communicated to the gaming machine 2000. In another embodiment, the instructions may be stored on another form of a tangible, non-transitory computer readable medium, such as shown at 2018. For example, reference 2018 may be implemented as an optical disk, which may constitute a suitable data carrier to load the instructions stored thereon onto the gaming machine 2000, thereby re-configuring the gaming machine to one or more of the embodiments described and shown herein. In other implementations, reference 2018 may be embodied as an encrypted persistent memory such as a Flash drive. Other implementations are possible.

Another embodiment is a method of providing a game for a regulated gaming machine. Such a method may comprise providing an existing console or arcade-type game, the provided game comprising a plurality of game assets appearing onscreen during game play. The provided game may then be modified to accept funds from a player and to correspondingly establish player game credits. One or more of the plurality of in-game assets may be configured to generate a wagering opportunity when interacted with by the player. One or more player interactions may be received, via a user interface of the regulated gaming machine, with at least one the plurality of in-game assets. For each generated wagering opportunity, a determination may be made whether the received player interaction(s) resulted in a successful or an unsuccessful interaction with the in-game asset with which the player interacted. At least for each successful interaction, the time elapsed until successful interaction may be generated, as may be a wagering event. For at least some of the generated wagering events, the determined time elapsed until successful interaction may be used to select one of a plurality of payout schedules, each of the plurality of payout schedules being associated with a different return to player (RTP) percentage. An award of player game credits to the player may be generated according to the selected payout schedule and the RTP associated with the selected payout schedule, such that shorter times elapsed until successful interaction cause a selection of payout schedules that are more advantageous to the player than comparatively longer times elapsed until successful interaction.

In the foregoing description, numerous specific details are set forth in order to provide a thorough understanding of one or more aspects and/or features of the exemplary embodiments. It will be apparent to one skilled in the art, however, that one or more aspects and/or features described herein may be omitted in favor of others or omitted all together. In some instances, the description of well-known process steps and/or structures are omitted for clarity or for the sake of brevity.

Herein, devices or processes that are described as being in communication with each other need not be in continuous communication with each other, unless expressly specified otherwise. In addition, devices or processes that are disclosed to be in communication with one another may communicate directly or indirectly through one or more intermediaries.

Further, although constituent steps of methods have been described in a sequential order, such methods may be configured to work in alternate orders. In other words, any sequence or order of steps that may be described herein does not, in and of itself, indicate a requirement that the steps be performed in that order. The steps of described processes may be performed in an order that differs from the order described herein. Further, some steps may be performed simultaneously despite being described or implied as occurring non-simultaneously (e.g., because one step is described after the other step). Moreover, the illustration of a process by its depiction in a drawing does not imply that the illustrated process is exclusive of other variations and modifications thereto, does not imply that the illustrated process or any of its steps are necessary to one or more of the invention(s), and does not imply that the illustrated process is preferred over other processes.

When a single device or article is described, it will be readily apparent that more than one device/article (e.g., whether or not they cooperate) may be used in place of a single device/article. Similarly, where more than one device or article is described (e.g., whether or not they cooperate), it will be readily apparent that a single device/article may be used in place of the more than one device or article. The functionality and/or the features of a device may be alternatively embodied by one or more other devices that are not explicitly described as having such functionality/features.

Lastly, while certain embodiments of the disclosure have been described, these embodiments have been presented by way of example only and are not intended to limit the scope of the disclosure. Indeed, the novel methods, devices and systems described herein may be embodied in a variety of other forms. Furthermore, various omissions, substitutions and changes in the form of the methods and systems described herein may be made without departing from the spirit of the disclosure. The accompanying claims and their equivalents are intended to cover such forms or modifications as would fall within the scope and spirit of the disclosure. For example, those skilled in the art will appreciate that in various embodiments, the actual physical and logical structures may differ from those shown in the figures. Depending on the embodiment, certain steps described in the example above may be removed, others may be added. Also, the features and attributes of the specific embodiments disclosed above may be combined in different ways to form additional embodiments, all of which fall within the scope of the present disclosure. Although the present disclosure provides certain preferred embodiments and applications, other embodiments that are apparent to those of ordinary skill in the art, including embodiments which do not provide all the features and advantages set forth herein, are also within the scope of this disclosure. Accordingly, the scope of the present disclosure is intended to be defined only by reference to the appended claims.

The invention claimed is:

1. A computer-implemented method of operating an electronic device, comprising:

accepting funds, by the electronic device, from a player and correspondingly establishing player game credits;

providing a game for the electronic device, the game being configured to present a plurality of in-game objectives, each being configured to generate a wagering event when achieved by the player;

receiving at least one player interaction, via a user interface of the electronic device, with the game;

determining whether the received at least one player interaction resulted in achieving at least one of the plurality of in-game objectives; and for each wagering event generated as a result of an achieved in-game objective, determining a time elapsed from presentment of the in-game objective in the game to achievement thereof; and for at least some of the generated wagering events:

using at least the determined time elapsed to select one of a plurality of payout schedules, each of the plurality of payout schedules being associated with at least one different characteristic that affects payouts to the player; and generating a random number and an award of player game credits to the player at least according to the generated random number and the selected payout schedule, wherein shorter determined times elapsed cause a selection of payout schedules that are, on average, comparatively more advantageous to the player than comparatively longer determined times elapsed.

2. The computer-implemented method of claim 1, wherein at least some of the plurality of payout schedules are associated with respectively different ranges of times elapsed from presentment of the in-game objective in the game to achievement thereof.

3. The computer-implemented method of claim 2, wherein the plurality of payout schedules comprises:

a first payout schedule and a first associated Return To Player (RTP) that is configured to be selected when the determined time elapsed is within a first range of times elapsed;

a second payout schedule and a second associated RTP that is configured to be selected when the determined time elapsed is within a second range of times elapsed; and a third payout schedule and a third associated RTP that is configured to be selected when the determined time elapsed is within a third range of times elapsed.

4. The computer-implemented method of claim 1, wherein determining the time elapsed comprises measuring a time elapsed between a time at which the in-game objective becomes available for player interaction and a last-received player interaction that results in achieving the in-game objective.

5. The computer-implemented method of claim 1, wherein using at least the determined time elapsed to select one of a plurality of payout schedules further comprises assessing a degree of difficulty in achieving the in-game objective and causing the assessed degree of difficulty and the determined time elapsed to influence the selection of one of the plurality of payout schedules.

6. The computer-implemented method of claim 1, wherein each of the plurality of in-game objectives requires a plurality of acts to be carried out by the player via interactions with the user interface of the electronic device.

7. An electronic device configured to enable a player to play a game, comprising:

a memory;

a user interface;

a processor coupled to the memory and to the user interface, and a plurality of processes spawned by the processor, the plurality of processes comprising processing logic to:

accept funds, by the electronic device, from a player and correspondingly establish player game credits;

provide a game for the electronic device, the game being configured to present a plurality of in-game objectives, each of the plurality of in-game objectives being configured to generate a wagering event when achieved by the player;

receive at least one player interaction, via a user interface of the electronic device, with the game;

determine whether the received at least one player interaction resulted in achieving at least one of the plurality of in-game objectives; and for each wagering event generated as a result of an achieved in-game objective, determine a time elapsed from presentment of the in-game objective in the game to achievement thereof; and for at least some of the generated wagering events:

use at least the determined time elapsed to select one of a plurality of payout schedules, each of the plurality of payout schedules being associated with at least one different characteristic that affects payouts to the player; and generate a random number and an award of player game credits to the player at least according to the generated random number and the selected payout schedule, wherein shorter determined times elapsed cause a selection of payout schedules that are, on average, comparatively more advantageous to the player than comparatively longer determined times elapsed.

8. The electronic device of claim 7, wherein at least some of the plurality of payout schedules are associated with respectively different ranges of times elapsed from presentment of the in-game objective in the game to achievement thereof.

9. The electronic device of claim 7, wherein the plurality of payout schedules comprises:

a first payout schedule and a first associated Return To Player (RTP) that is configured to be selected when the determined time elapsed is within a first range of times elapsed;

a second payout schedule and a second associated RTP that is configured to be selected when the determined time elapsed is within a second range of times elapsed; and a third payout schedule and a third associated RTP that is configured to be selected when the determined time elapsed is within a third range of times elapsed.

10. The electronic device of claim 7, wherein the processing logic to determine the time elapsed comprises processing logic to measure a time elapsed between a time at which the in-game objective becomes available for player interaction in the game and a last-received player interaction with the in-game objective that results in achieving the in-game objective.

11. The electronic device of claim 7, wherein the processing logic to use at least the determined time elapsed to select one of a plurality of payout schedules further comprises processing logic to assess a degree of difficulty in achieving the in-game objective and to cause the assessed degree of difficulty and the determined time elapsed to influence the selection of one of the plurality of payout schedules.

12. The electronic device of claim 7, wherein each of the plurality of in-game objectives requires a plurality of acts to be carried out by the player via interactions with the user interface of the electronic device.

13. A computer-implemented method of operating a electronic device, comprising:

accepting funds, by the electronic device, from a player and correspondingly establishing player game credits;

providing a game for the electronic device, the game being configured to present a plurality of in-game objectives, each of the plurality of in-game objectives being configured to generate a wagering event when achieved by the player;

receiving at least one player interaction, via a user interface of the electronic device, with the game;

determining whether the received at least one player interaction resulted in achieving at least one of the plurality of in-game objectives; and for each wagering event generated as a result of an achieved in-game objective, determining a time elapsed from presentment of the in-game objective in the game to achievement thereof; and for at least some of the generated wagering events:

modifying a payout schedule associated with the game to have a different Return to Player (RTP) using at least one of mathematical and logical operators and the determined time elapsed, such that using a shorter determined time elapsed to modify the payout schedule results in a higher RTP and such that using a comparatively longer determined time elapsed to modify the payout schedule results in a comparatively lower RTP, and generating a random number and an award of player game credits to the player at least according to the generated random number and the modified payout schedule.

14. The computer-implemented method of claim 13, wherein determining the time elapsed comprises measuring a time elapsed between a time at which the in-game objective becomes available for player interaction and a last player interaction with the in-game objective that results in achieving the in-game objective.

15. The computer-implemented method of claim 13, wherein using at least the determined time elapsed to select one of a plurality of payout schedules further comprises assessing a degree of difficulty in achieving the in-game objective and causing the assessed degree of difficulty and the determined time elapsed to influence the selection of one of the plurality of payout schedules.

16. The computer-implemented method of claim 13, wherein each of the plurality of in-game objectives requires a plurality of acts to be carried out by the player via interactions with the user interface of the electronic device.

17. An electronic device configured to enable a player to play a game, comprising:

a memory;

a user interface;

a processor coupled to the memory and to the user interface, and a plurality of processes spawned by the processor, the plurality of processes comprising processing logic to:

accept funds, by the electronic device, from a player and correspondingly establishing player game credits;

provide a game for the electronic device, the game being configured to present a plurality of in-game objectives, each of the plurality of in-game objectives being configured to generate a wagering event when achieved by the player;

receive at least one player interaction, via a user interface of the electronic device, with the game;

determine whether the received at least one player interaction resulted in achieving at least one of the plurality of in-game objectives; and for each wagering event generated as a result of an achieved in-game objective, determine a time elapsed from presentment of the in-game objective in the game to achievement thereof; and for at least some of the generated wagering events:

modify a payout schedule associated with the game to have a different Return to Player (RTP) using at least one of mathematical and logical operators and the determined time elapsed, such that using a shorter determined time elapsed to modify the payout schedule results in a higher RTP and such that using a comparatively longer determined time elapsed to modify the payout schedule results in a comparatively lower RTP, and generate a random number and an award of player game credits to the player at least according to the generated random number and the modified payout schedule.

18. The electronic device of claim 17, wherein the processing logic determine the time elapsed comprises processing logic to measure a time elapsed between a time at which the in-game objective becomes available for player interaction and a last player interaction with the in-game objective that results in achieving the in-game objective.

19. The electronic device of claim 17, wherein the processing logic to use at least the determined time elapsed to select one of a plurality of payout schedules further comprises processing logic to assess a degree of difficulty in achieving the in-game objective and cause the assessed degree of difficulty and the determined time elapsed to influence the selection of one of the plurality of payout schedules.

20. The electronic device of claim 17, wherein each of the plurality of in-game objectives requires a plurality of acts to be carried out by the player via interactions with the user interface of the electronic device.

* * * * *